US008448269B2

(12) United States Patent
Libit et al.

(10) Patent No.: US 8,448,269 B2
(45) Date of Patent: May 28, 2013

(54) BATHTUB INSERT

(75) Inventors: Sidney M. Libit, Longboat Key, FL (US); Jeffrey M. Libit, Alburquerque, NM (US)

(73) Assignee: Jeffrey M. Libit, Alburquerque, NM (US)

( * ) Notice: Subject to any disclaimer, the term of this patent is extended or adjusted under 35 U.S.C. 154(b) by 1018 days.

(21) Appl. No.: 12/195,500

(22) Filed: Aug. 21, 2008

(65) Prior Publication Data

US 2008/0301868 A1 Dec. 11, 2008

Related U.S. Application Data

(63) Continuation-in-part of application No. 11/868,260, filed on Oct. 5, 2007, now abandoned.

(60) Provisional application No. 60/828,504, filed on Oct. 6, 2006.

(51) Int. Cl.
*A47K 3/022* (2006.01)

(52) U.S. Cl.
USPC ..... 4/565.1; 4/555; 4/577.1; 4/578.1; 4/579; 4/589; 4/590; 4/584

(58) Field of Classification Search
USPC ..... 4/571.1, 546, 550, 552, 55, 556, 4/558, 560.1, 565.1, 568, 576, 573.1, 577.1, 4/584, 585, 589, 592, 591, 595, 597, 600, 4/604, 611, 612, 614, 553–555, 576.1
See application file for complete search history.

(56) References Cited

U.S. PATENT DOCUMENTS

| | | | | |
|---|---|---|---|---|
| 3,096,526 | A * | 7/1963 | Vecenie | 4/590 |
| 3,423,769 | A * | 1/1969 | Cowley | 4/556 |
| 3,663,971 | A * | 5/1972 | Bonhote | 4/556 |
| 3,864,762 | A | 2/1975 | Finch et al. | |
| 4,023,220 | A | 5/1977 | Younker | |
| D248,107 | S | 6/1978 | Brengford et al. | |
| 4,112,524 | A | 9/1978 | Johansson | |
| 4,202,060 | A * | 5/1980 | Touze | 4/556 |
| 4,276,919 | A * | 7/1981 | Walters | 160/206 |
| 4,337,540 | A | 7/1982 | Lindeman | |
| 4,583,251 | A * | 4/1986 | Furst et al. | 4/555 |

(Continued)

FOREIGN PATENT DOCUMENTS

CA 2379655 A1 * 10/2003

*Primary Examiner* — Jeanette E. Chapman
(74) *Attorney, Agent, or Firm* — Michael Best & Friedrich LLP

(57) ABSTRACT

A bathing insert for use with a bathing space, the bathing insert comprising a body including first and second end walls, first and second side walls extending between the end walls, and a support wall connecting first edges of the end walls and the side walls. The walls define an open edge and an interior area of the body. A seat including a sit portion extending generally inward from the first end wall and a seatback portion extending from the support wall to the sit portion, wherein the sit portion and the seatback portion connect to define the seat. The body is positionable in a first orientation for use as a shower seat and a second orientation for use as a bathtub. When the body is in the first orientation, the open edge is positionable on a support surface, and when the body is in the second orientation, the support wall is positionable on the support surface such that the interior area is accessible by a user.

14 Claims, 23 Drawing Sheets

U.S. PATENT DOCUMENTS 4,817,219 A * 4/1989 Schenstrom ..... 4/555
4,970,734 A 11/1990 Friedman et al.
5,335,377 A * 8/1994 Masyada et al. ..... 4/578.1
5,341,524 A * 8/1994 Zellner ..... 4/555
5,343,575 A * 9/1994 Cartwright ..... 4/547
5,588,159 A * 12/1996 Poulson et al. ..... 4/572.1
5,940,902 A 8/1999 Onge et al.
6,151,727 A 11/2000 Lofquist, Jr.

* cited by examiner

BATHTUB INSERT

CROSS-REFERENCE TO RELATED APPLICATION

This application claims priority to U.S. patent application Ser. No. 11/868,260, entitled "Bathtub Insert", filed Oct. 5, 2007 by Sidney M. Libit and Jeffrey M. Libit as a continuation-in-part application, which claims priority to U.S. Provisional Application No. 60/828,504, entitled "Bathtub Insert", filed Oct. 6, 2006 by Sidney M. Libit and Jeffrey M. Libit. The entire contents of both applications are hereby incorporated by reference.

BACKGROUND

The present invention relates to a bathing insert, and in particular an insert that allows older and disabled persons to more easily enter and exit a bathtub or shower stall to bathe.

Existing conventional bathtubs and showers are designed for an "average" person, but such tubs are difficult to use by persons with disabilities and the elderly. The vertical walls of conventional bathtubs must be stepped over to enter and exit the tub, which is difficult or impossible for some people. Some devices are available to assist disabled or elderly persons in entering, exiting and using showers, but many such devices do not allow a user to soak or use a bathtub, or to retrofit or be temporarily installed in an existing bathtub or shower unit.

SUMMARY

In one embodiment, the invention provides a bathing insert for use with a bathing space. The bathing insert includes a body including first and second end walls, first and second side walls extending between the end walls, and a support wall connecting first edges of the end walls and the side walls, wherein the walls define an open edge and an interior area of the body. A seat including a sit portion extending generally inward from the first end wall and a seatback portion extending from the support wall to the sit portion, wherein the sit portion and the seatback portion connect to define the seat. The body is positionable in a first orientation for use as a shower seat and a second orientation for use as a bathtub. When the body is in the first orientation, the open edge is positionable on a support surface, and when the body is in the second orientation, the support wall is positionable on the support surface such that the interior area is accessible by a user.

In another embodiment, the invention provides a bathing insert for use with a bathing space. The bathing insert includes a body including first and second end walls, first and second side walls extending between the end walls, and a support wall connecting first edges of the end walls and the side walls, wherein the walls define an open edge and an interior area of the body. The body is positionable in a first orientation for use as a shower seat, in which the open edge is positionable on a support surface, and a second orientation for use as a bathtub, in which the support wall is positionable on the support surface such that the interior area is accessible by a user. The bathing insert also includes a seat having sit portion extending generally inward from the first end wall and a seatback portion extending from the support wall to the sit portion, wherein the sit portion and the seatback portion connect to define the seat. A pair of handles extending between the sit portion and the seatback portion, wherein the handles combine with the support wall of the body to support the body when in the second orientation. A door is formed in at least one of the walls, the door for providing access to the interior area of the body when the body is positioned in the second orientation.

In another embodiment, the invention provides a bathing insert for use with a bathing space. The bathing insert includes a body including first and second end walls, first and second side walls extending between the end walls, and a support wall connecting first edges of the end walls and the side walls, wherein the walls define an open edge and an interior area of the body. The bathing insert also includes a first door member positioned in at least one of the side walls and a second door member positioned proximate the first door member, wherein the first and second door members define a door for providing access to the interior area of the body and each door member is separately removable from the respective wall.

In another embodiment, the invention provides a bathing insert for use with a bathing space. The bathing insert includes a body including first and second end walls, first and second side walls extending between the end walls, and a support wall connecting first edges of the end walls and the side walls, wherein the walls define an open edge and an interior area of the body. The bathing insert also includes a seat including a sit portion extending generally inward from the first end wall and a seatback portion extending from the support wall to the sit portion, wherein the sit portion and seatback portion connect to define the seat, wherein the seat extends partially external of the bathing space. A pair of handles extend from the sit portion of the seat, wherein when the body is positionable within the bathing space, the support wall of the body is positioned within the bathing space and the handles are exterior of the bathing space to further support the body.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description of the embodiments provided as examples and should not be regarded as limiting.

DETAILED DESCRIPTION

This invention relates to a bathing insert or a bathtub insert configured for fitting within an existing bathtub or shower stall and utilizing an existing shower head. The bathtub insert provides a deeper and more convenient bathing facility within the confines of a generally conventional installed bathtub or shower stall. The insert forms a deeper tub relative to the existing space and the insert walls extend higher than those of an existing tub. The insert includes a seat formed therein and is sized to fit within the existing tub or shower stall. In one embodiment, the insert includes fixed walls and a sealing pivotal door. The door allows a disabled or elderly person to more easily enter and exit the bathtub by sliding onto the seat. In a further embodiment, the walls may be telescoping or include a pivotally connected upper section.

The water level is raised within the insert such that a person may sit on the seat and take a bath. The insert does not require any additional plumbing as the water supply may be provided by the existing shower head or bathtub faucet; therefore, no additional plumbing, electrical or mechanical lines are required to use the insert. Further, the insert is sized to fit within conventional bathtubs and shower stalls to allow a "one size fits all" device. In one embodiment, the insert includes a drain for draining water from the insert.

In one embodiment, the insert is positionable in two different orientations. In a first orientation, the insert defines a shower seat for a user. In a second orientation or inverted position, the insert defines an easily accessible bathing area for a user, including a seat and access door.

FIGS. 1A, 1B, 2A, and 2B illustrate a bathtub insert 10, or bathing insert, according to one embodiment of the invention. The bathtub insert 10 provides an easily accessible and deeper bathing area than conventional bathtubs. The bathtub insert 10 is configured for use with a conventional bathtub or shower stall. In the illustrated embodiment, the bathtub insert 10 may be positioned in a bathing space, such as a bathtub or a shower stall (not shown) in a first orientation for use as a shower seat (FIGS. 1A and 1B) and in a second orientation (FIGS. 2A and 2B) for use as a deeper bathtub.

Figure 1B:
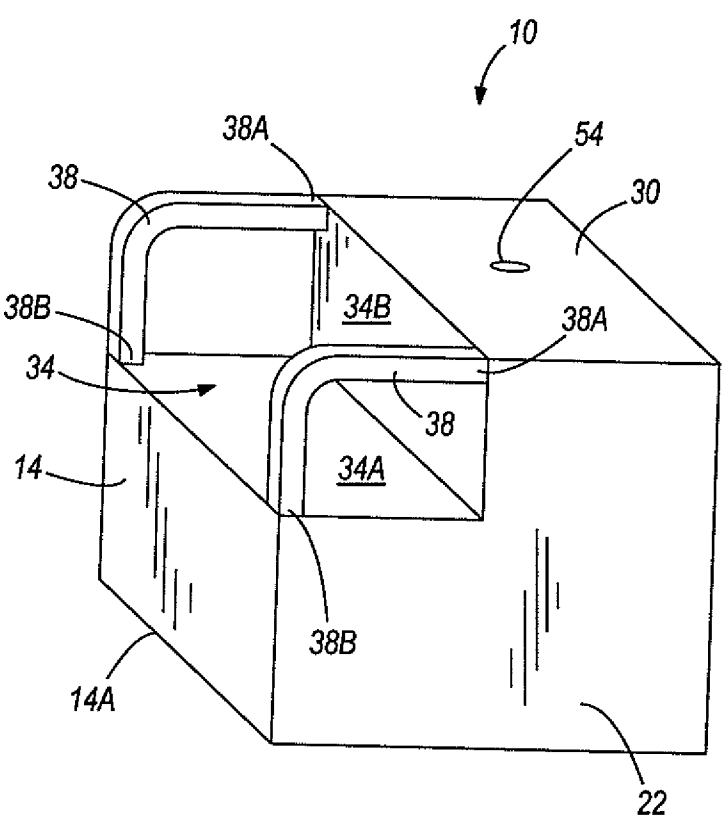
FIGS. 1A and 1B illustrate a bathing insert according to one embodiment of the invention, the bathing insert positioned in a first orientation to provide a seat.
Figure 1A:
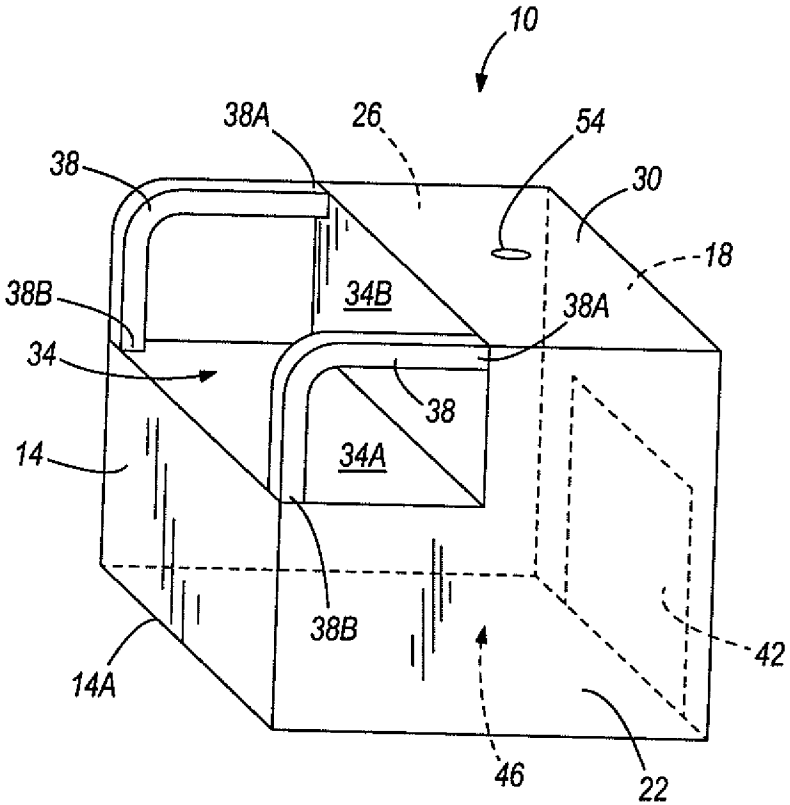

Referring to FIGS. 1A and 1B, the bathtub insert 10 includes a first end wall 14, a second end wall 18, two side walls 22, 26 extending between the end walls 14, 18, and an upper wall 30. As will become clear in FIGS. 2A and 2B, the insert 10 does not include a lower wall. A seat 34 is defined between the first end wall 14 and the upper wall 30. The seat 34 includes a sit portion 34A extending generally inward from and substantially perpendicular to the first end wall 14, and a seatback portion 34B extending generally downward from and substantially perpendicular to the upper wall 30. In the illustrated embodiment, the sit portion 34A of the seat 34 is about 21 inches above a lower edge 14A of the first end wall 14 and recessed from the upper wall 30 about 15 inches. The seat 34 provides a sitting area for a user when the insert 10 is positioned in the first orientation, and allows a user to sit down while taking a shower. The sit portion 34A supports the user's posterior and the seatback portion 34B provides a backrest for the user.

The bathtub insert 10 includes a pair of generally L-shaped rails 38 positioned adjacent the seat 34. Each rail 38 includes a first end 38A mounted proximate the intersection of the upper wall 30 and the respective side wall 22, 26 and a second end 38B mounted proximate the intersection of the first end wall 14 and the respective side wall 22, 26. As shown in FIG. 1A, the second end wall 18 of the insert 10 includes a door 42 for providing access to a bathing area 46, as discussed below.

Figure 2B:
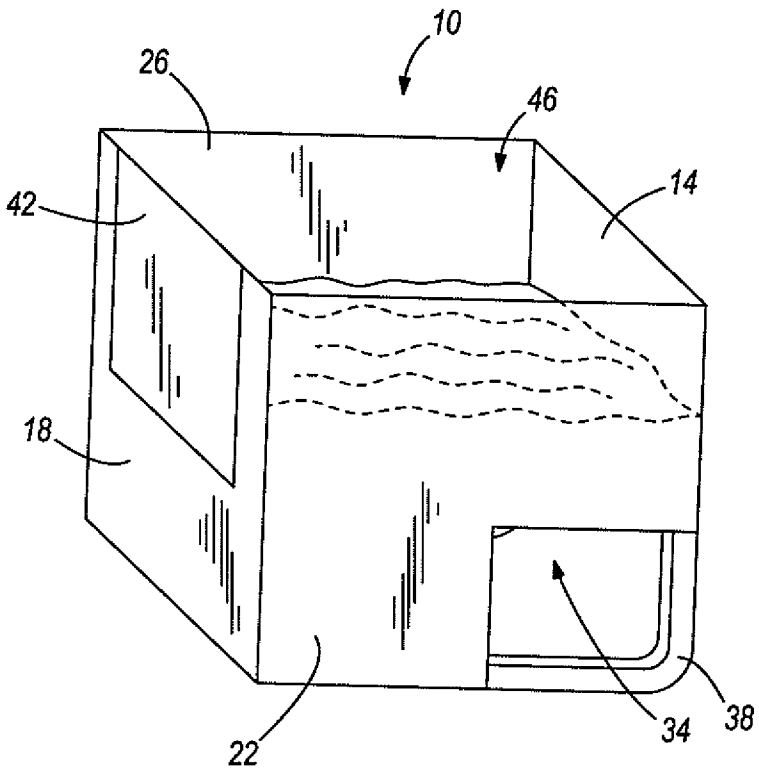
FIGS. 2A and 2B illustrate the bathing insert shown in FIGS. 1A and 1B positioned in a second orientation to provide a bathtub.
Figure 2A:
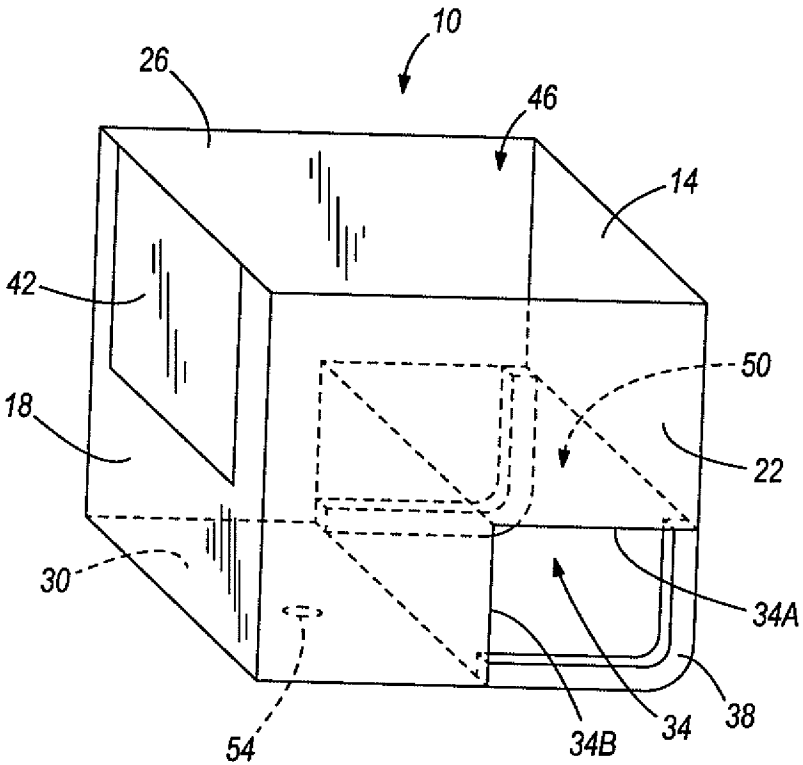

Referring to FIGS. 2A and 2B, by inverting the bathtub insert 10 (i.e., rotating the insert 10 approximately 180°) to the second orientation, the bathtub insert 10 provides the bathing area 46 for a user. In the second orientation, the upper wall 30 and the rails 38 of the insert 10 define a base surface that rests upon a bottom of the bathtub for supporting the insert 10. The walls 14-30 of the insert 10 define the bathing area 46 with an open end for gaining access to the bathing area 46 and supplying water to the bathing area 46. In the illustrated embodiment, the end walls 14, 18 and the side walls 22, 26 of the insert 10 extend higher than walls of the existing bathtub to define a deeper bathing area 46 than the existing bathtub.

The door 42 formed in the second end wall 18 of the insert 10 provides access to and from the bathing area 46 of the insert 10. The door 42 allows a user to easily slide or step into the bathing area 46 from the bathtub, shower stall, or bathroom. In the illustrated embodiment, the door 42 has a height of about 21 inches and is spaced from the upper wall 30 (i.e., begins above the upper wall in FIGS. 2A and 2B) by about 15 inches. Preferably, the door 42 is sealed such that water within the bathing area 46 (see FIG. 2B) does not leak from the insert 10.

In one embodiment, the door includes a dagger board inserted into a groove slot formed in the second end wall surrounding the door opening. In another embodiment, the door includes a hinged door that folds by a hinge and opens outwardly with respect to the bathing area. The hinge may be molded in plastic as a live hinge or metal and attached to the door and insert in a conventional manner. Both doors include grommet material to secure a seal to the inner or outer periphery of the door opening. In still another embodiment, the door includes a hinged door coupled to an interior surface of the insert (i.e., the second end wall). The door is larger than a width or a length of the door opening and is creased in the middle, similar to a folding door. The door includes a seal (e.g., formed from rubber or plastic) positioned about the inner or outer periphery of the door opening.

Referring to FIG. 2A, the sit portion 34A and the seatback portion 34B of the seat 34 (when the bathtub insert 10 is in the first orientation) define a second seat 50 when the insert 10 is in the second orientation. The sit portion 50A of the second seat 50 may be used as a seat to support a posterior of the user while bathing or a step, while the seatback portion 34B extends generally parallel and adjacent to the user's legs while the user is seated. In the illustrated embodiment, the second seat 50 is raised about 15 inches from the upper wall 30 of the insert 10. The upper wall 30 of the insert 10 includes a closeable drain 54 for allowing water to drain from the bathing area 46.

In one embodiment, the bathtub insert 10 is fabricated from aluminum. In another embodiment, the insert 10 is fabricated from a plastic material using an injection molding process, a roto-molding process, or the like.

Figure 3:
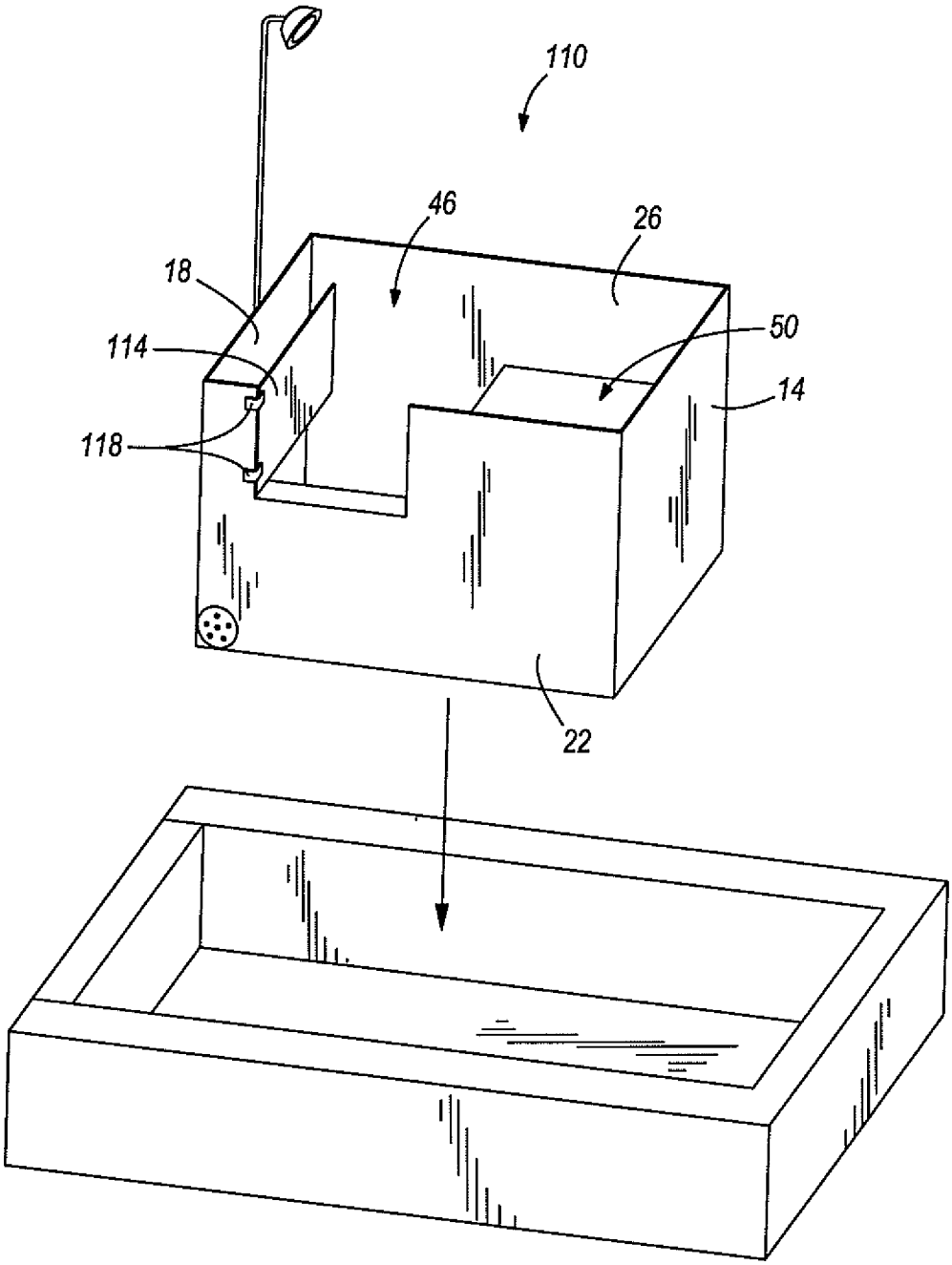
FIG. 3 illustrates a bathing insert according to another embodiment of the invention, the insert positioned to provide a bathing area.

FIG. 3 illustrates an invertable bathtub insert 110, or bathing insert, according to another embodiment of the bathtub insert 10 shown in FIGS. 1A, 1B, 2A and 2B, whereby like elements will be identified by the same reference numerals. In FIG. 3, the insert 10 is shown in the second orientation for positioning within a conventional bathtub and providing the bathing area 46 for a user. In this illustrated embodiment, a door 114 is coupled to one of the side walls 22, 26 of the insert 110 to provide access to the bathing area 46. The door 114 is coupled to the side wall by hinges 118 such that the door 114 pivots inwardly toward the bathing area 46 when opened.

Figure 4A:
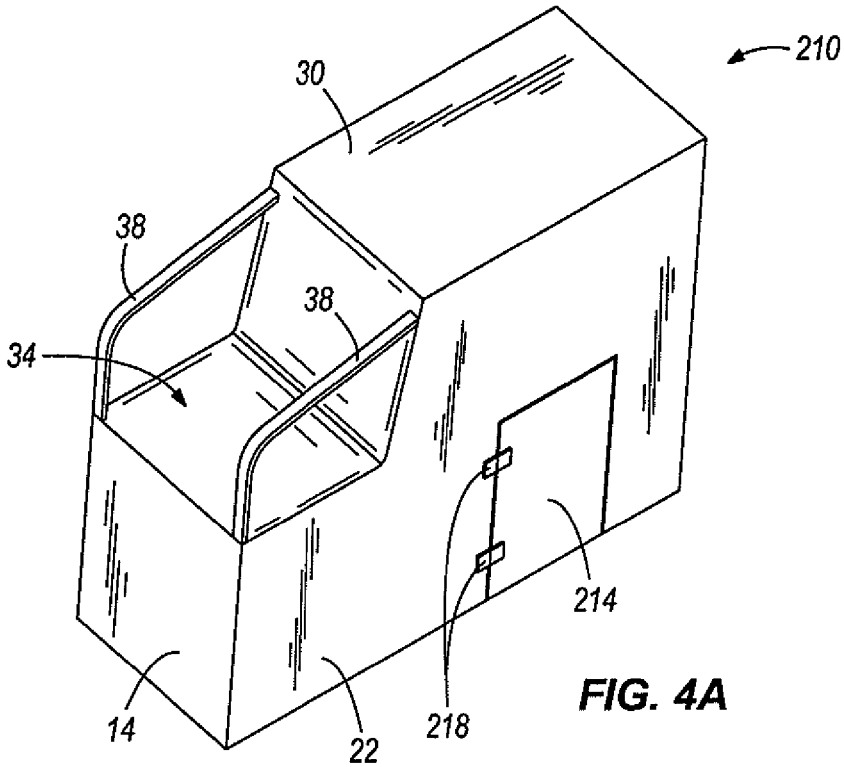
FIGS. 4A and 4B illustrate a bathing insert according to another embodiment of the invention, the bathing inserted positionable in a first orientation (FIG. 4A) to provide a seat and a second orientation (FIG. 4B) to provide a bathtub.
Figure 4B:
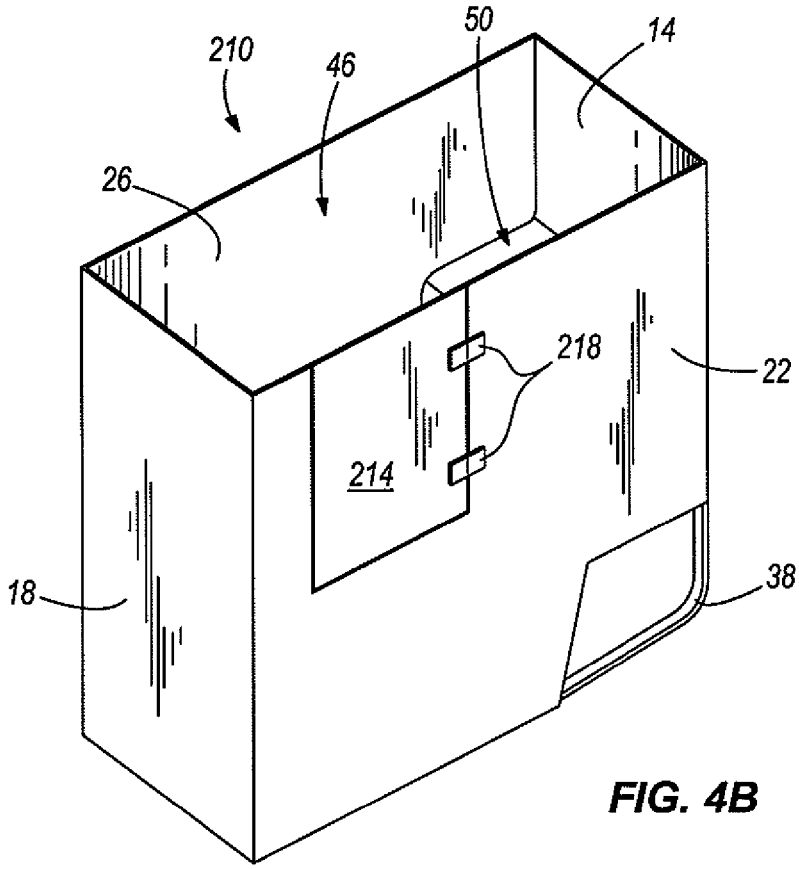

FIGS. 4A and 4B illustrate an invertable bathtub insert 210, or bathing insert, according to another embodiment of the bathtub insert 10 shown in FIGS. 1A, 1B, 2A and 2B, whereby like elements will be identified by the same reference numerals. FIG. 4A shows the insert 210 in the first orientation for use as a shower seat and FIG. 4B shows the insert 210 in the second orientation for use as a bathtub. In this illustrated embodiment, a door 214 is coupled to one of the side walls 22, 26 of the insert 210 to provide access to the bathing area 46. The door 214 is coupled to the side wall by hinges 218 such that the door 214 pivots inwardly toward the bathing area 46 (second orientation) when opened.

Figure 5:
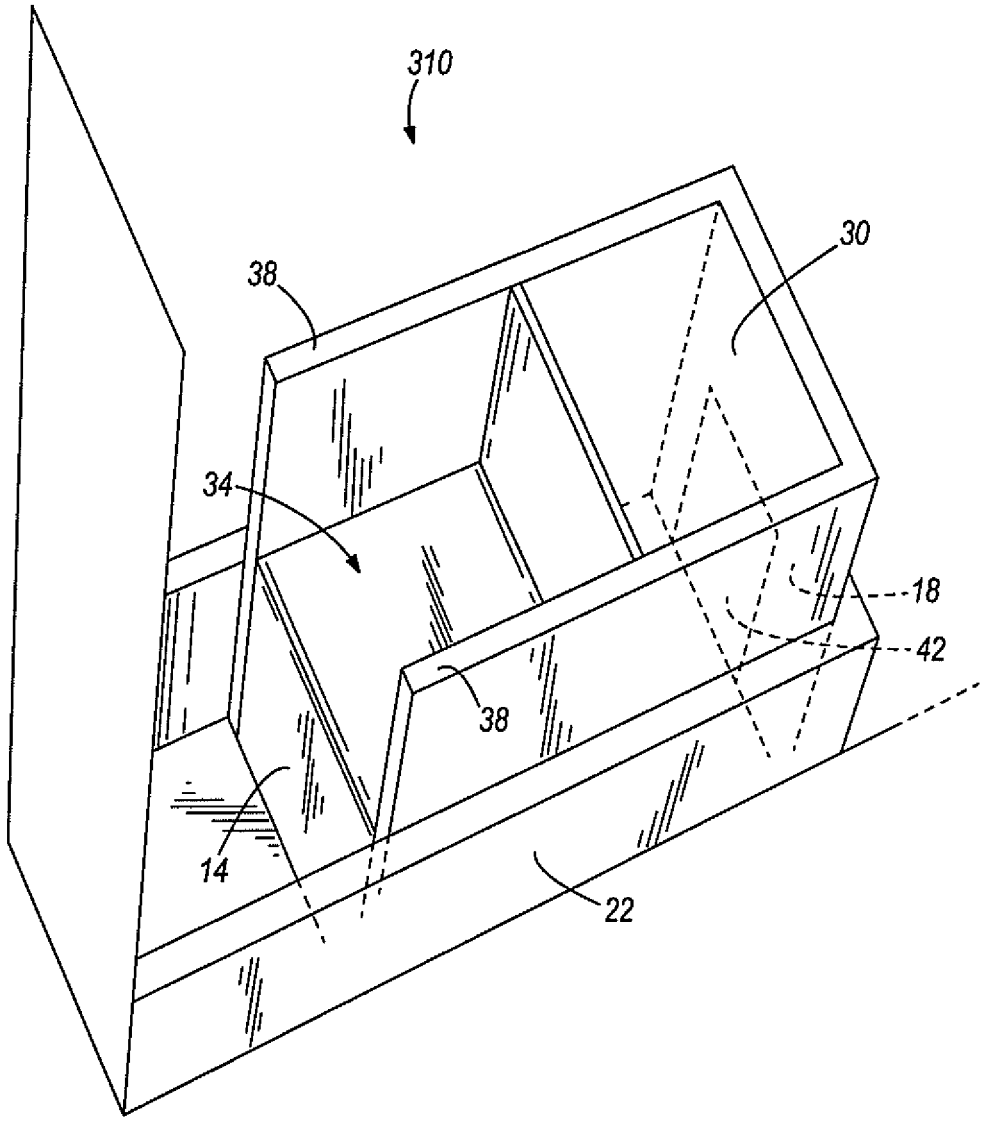
FIG. 5 illustrates a bathing insert according to another embodiment of the invention, the insert positioned to provide a seat.

FIG. 5 illustrates an invertable bathtub insert 310, or bathing insert, according to another embodiment of the bathtub insert 10 shown in FIGS. 1A, 1B, 2A and 2B, whereby like elements will be identified by the same reference numerals. In FIG. 5, the insert 310 is shown in the first orientation for positioning within a conventional bathtub and providing the sitting area for a user. Although not shown in FIG. 5, the door 42 is coupled to the second end wall 18 of the insert 310 for providing access to the bathing area (not shown) when the insert 310 is positioned in the second orientation.

Figure 6:
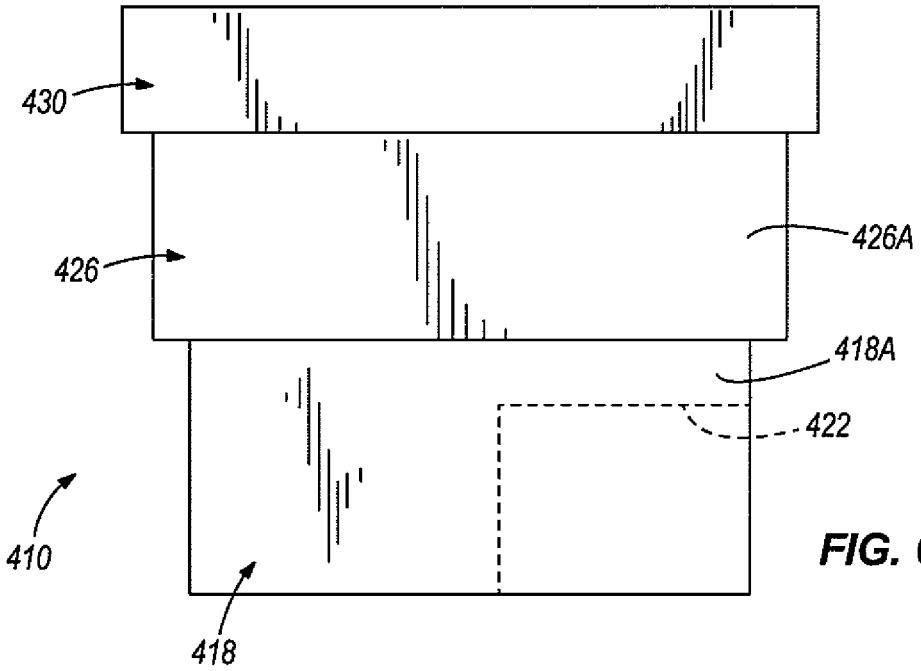
FIG. 6 illustrates a telescoping bathing insert according to another embodiment of the invention.
Figure 7:
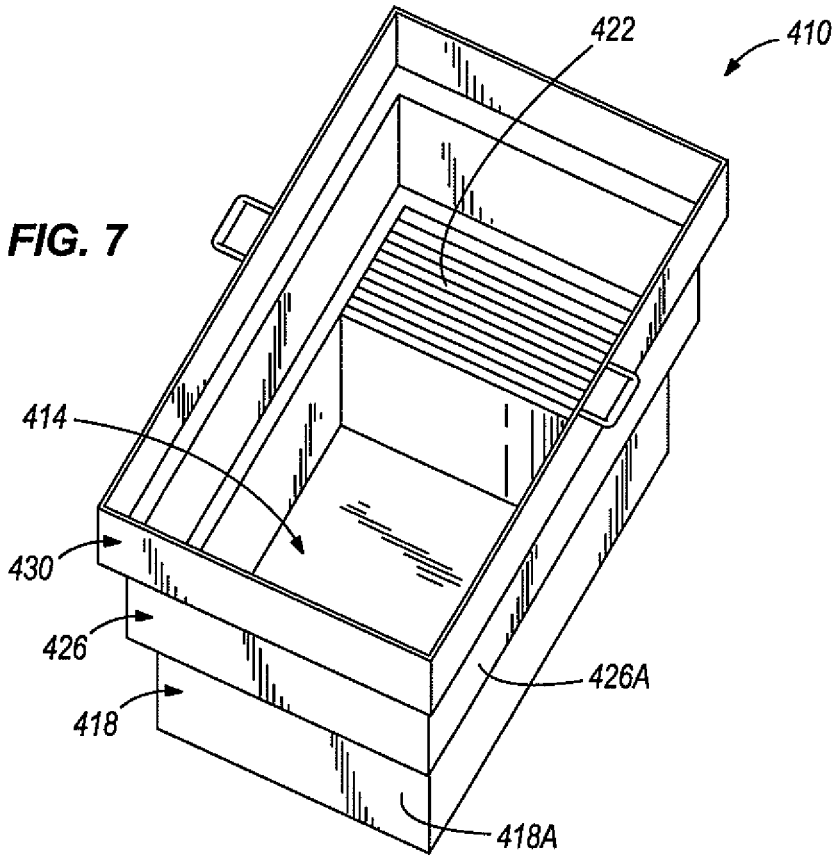
FIG. 7 is a top perspective view of the bathing insert shown in FIG. 6.

FIGS. 6 and 7 illustrate a bathtub insert 410, or bathing insert, according to another embodiment of the invention. The insert 410 is a telescoping bathtub configured for use with a conventional bathtub or shower stall. The insert 410 is shown in a telescoped position in FIGS. 6 and 7. A conventional bathtub has a depth of about 12 inches; however, in the illustrated embodiment the telescoping insert 410 provides a bathing area 414 having a depth of about 36 inches.

The bathtub insert 410 includes three generally rectangular portions that are slidably coupled together in a telescoping relationship. A lower portion 418 provides a base for the insert 410 and is positioned within, on, or around the existing bathtub (not shown). In the illustrated embodiment, the lower portion 418 includes a seat 422 for a user to sit on or step on during use. A central portion 426 is slidably coupled to an exterior surface 418A of the lower portion 418 and an upper portion 430 is slidably coupled to an exterior surface 426A of the upper portion 430. In one embodiment, seals are positioned between the coupled portions 418, 426, 430 to prevent water leakage. When the insert 410 is in a compacted position, the lower portion 418 is retained within the central portion 426, which is retained within the upper portion 430.

To move the insert 410 to the telescoped position for use, the upper portion 430 is lifted generally upward to pull the upper portion 430 and the central portion 426 away from the lower portion 418 and create the deeper bathing area 414. The three portions 418, 426, 430 thereby define the bathing area 414 for a user. Locking means (not shown) may be used to hold the insert 410 in the telescoped position. Water is supplied to the bathing area 414 from a shower head or bathtub faucet. In one embodiment, the lower portion 418 may include a closed bottom for holding water within the bathing area 414 and a closable drain for draining water from the bathing area 418. In a further embodiment, the lower portion 418 includes an open bottom.

Figure 8:
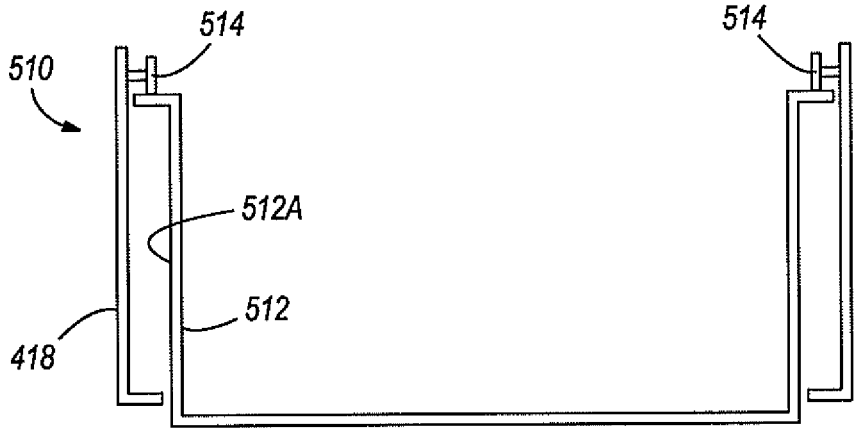
FIG. 8 illustrates a telescoping bathing insert coupled to an existing bathtub according to one embodiment of the invention.

FIG. 8 illustrates a telescoping bathtub insert 510, or bathing insert, according to another embodiment of the bathtub insert 410 shown in FIGS. 6 and 7, whereby like elements will be identified by the same reference numerals. FIG. 8 shows how the insert 510 is coupled to an existing bathtub 512. The lower portion 418 of the insert 510 slides over and around an exterior surface 512A of the existing bathtub 512. One or more peripheral seals 514 prevent water from leaking from the bathtub through the insert 510.

Figure 9A:
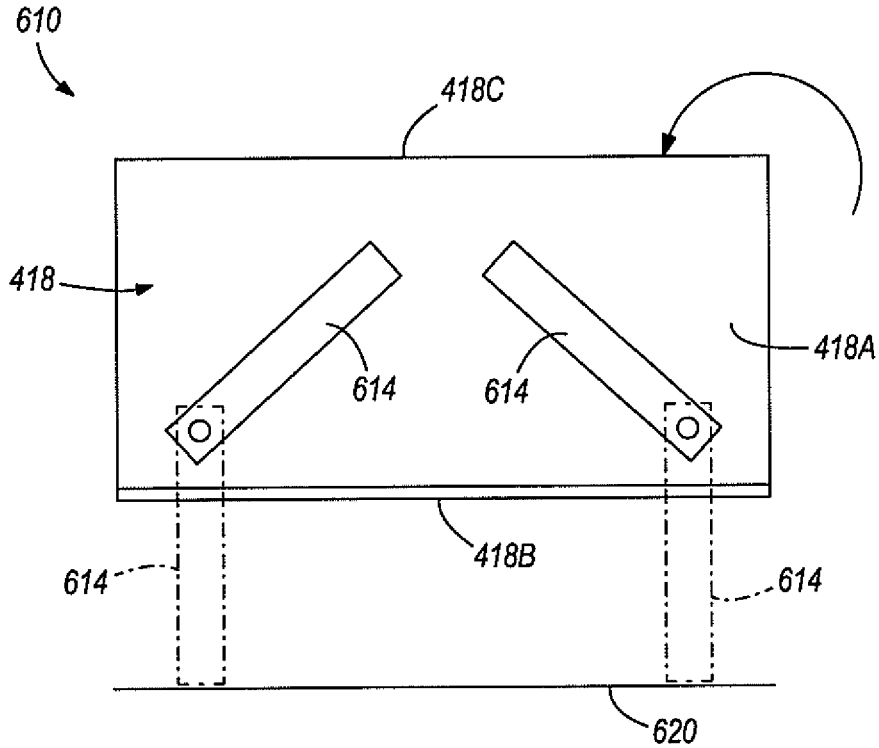
FIGS. 9A and 9B illustrate other embodiments of a telescoping bathing insert coupled to an existing bathtub.
Figure 9B:
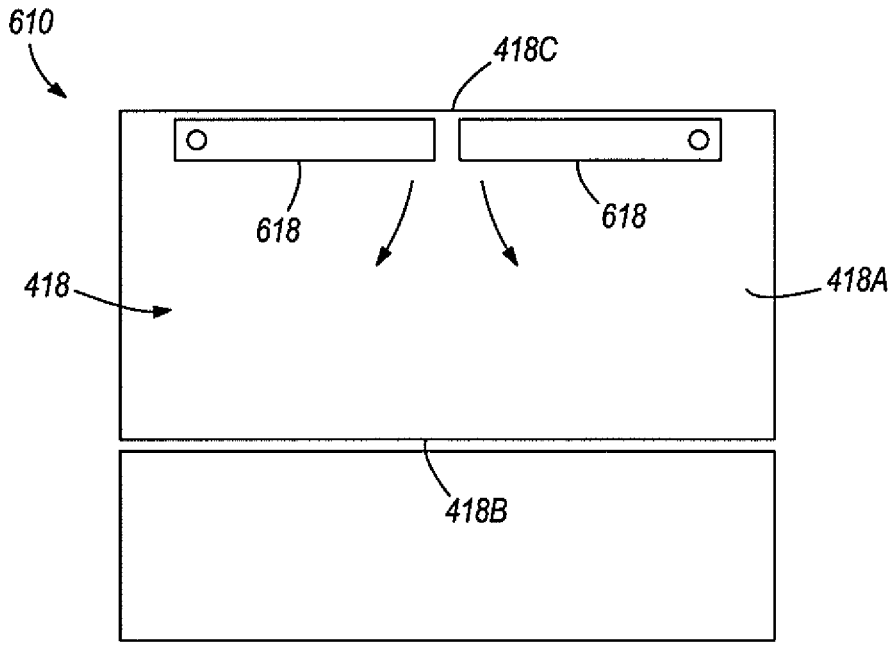

FIGS. 9A and 9B illustrate a telescoping bathtub insert 610, or bathing insert, according to another embodiment of the bathtub insert 410 shown in FIGS. 6 and 7, whereby like elements will be identified by the same reference numerals. FIG. 9A shows an alternate embodiment for mounting the insert 610 to an existing bathtub (not shown). The lower portion 418 of the insert 610 rests upon an upper edge of the existing bathtub. The insert 610 includes pivotable legs 614 coupled to an exterior surface 418A of the lower portion 418. In one embodiment, the pivotable legs 614 are positioned proximate a lower edge 418B of the lower portion 418. In a lowered position, shown by dashed lines in FIG. 9A, the legs 418 rest upon a floor 620 of the bathtub and support the insert 610 on the bathtub. One or more peripheral seals prevent water from leaking from the bathtub through the insert 610.

In another embodiment of the bathtub insert 610, pivotable legs 618 are positioned proximate an upper edge 418C of the lower portion 418, such that when in the lowered position, the legs 618 rest upon the upper edge of the bathtub to support the insert.

Figure 10:
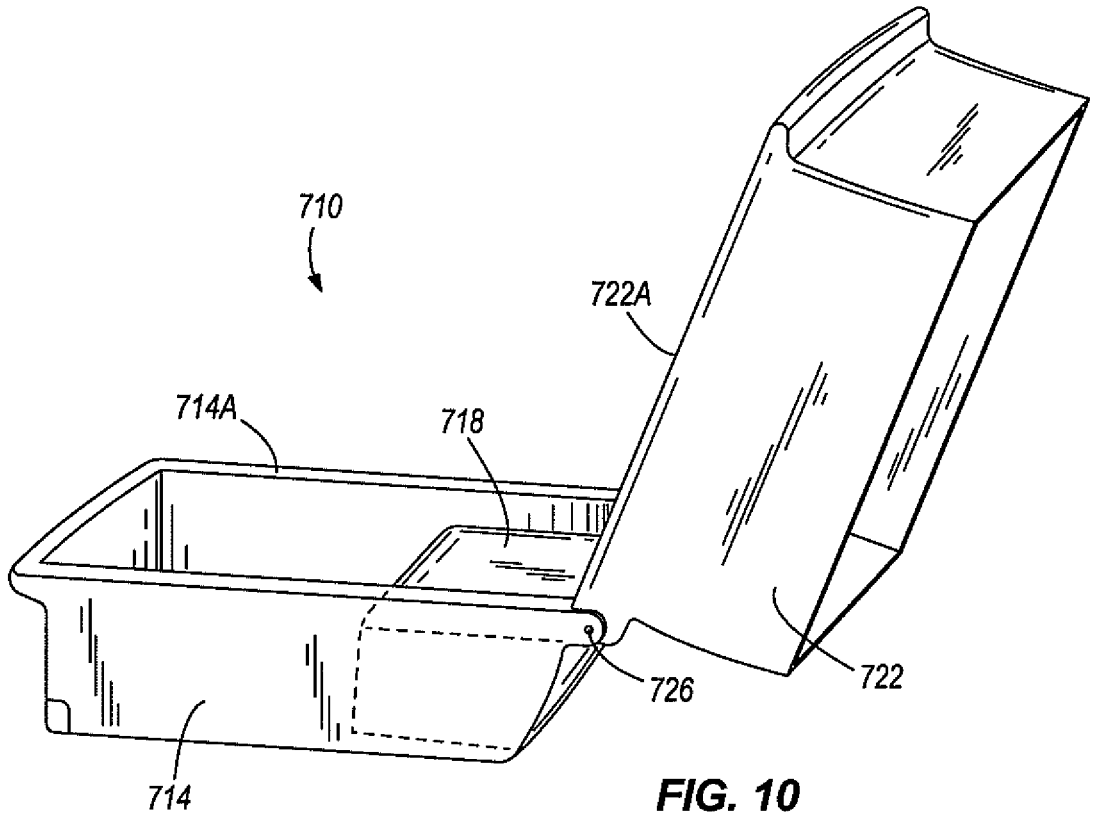
FIG. 10 illustrates a bathing insert according to another embodiment of the invention.

FIG. 10 illustrates a bathtub insert 710, or bathing insert, according to another embodiment of the invention. The insert 710 has a clamshell-type design and is configured for use with a conventional bathtub or shower stall. The insert 710 includes a lower portion 714 having a seat 718 and a pivotable upper portion 722 (shown in an open position in FIG. 10). The upper portion 722 and the lower portion 714 are hinged together along a rear edge 726 of the insert 710. During use, the lower portion 714 is received by the existing bathtub (not shown) and a user enters the insert 710 while the upper portion 722 is in the open position. The upper portion 722 is then moved to a closed position in which a lower edge 722A of the upper portion 722 rests upon or overlaps an upper edge 714A of the lower portion 714. The upper portion 722 includes an open top to allow a user to sit within the insert 710. In the closed position, the insert portions 714, 722 define a bathing area having a depth greater than a depth of the existing bathtub.

Figure 11:
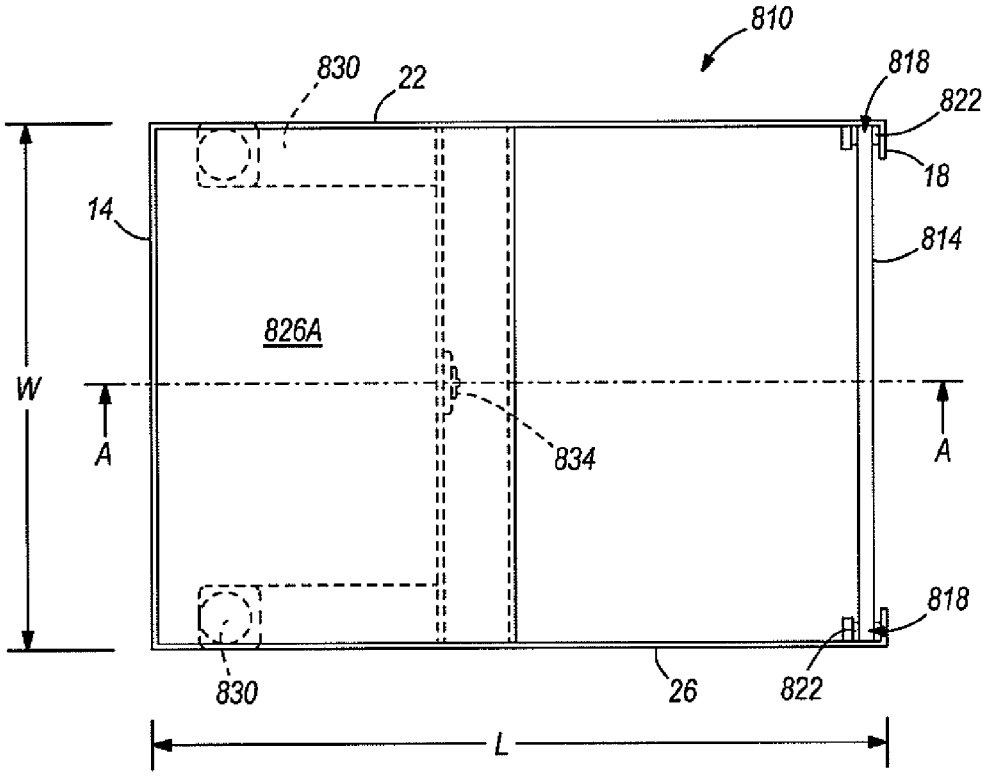
FIG. 11 is a plan view of a bathing insert according to another embodiment of the invention, the bathing insert positioned in a second orientation to provide a bathtub.
Figure 12:
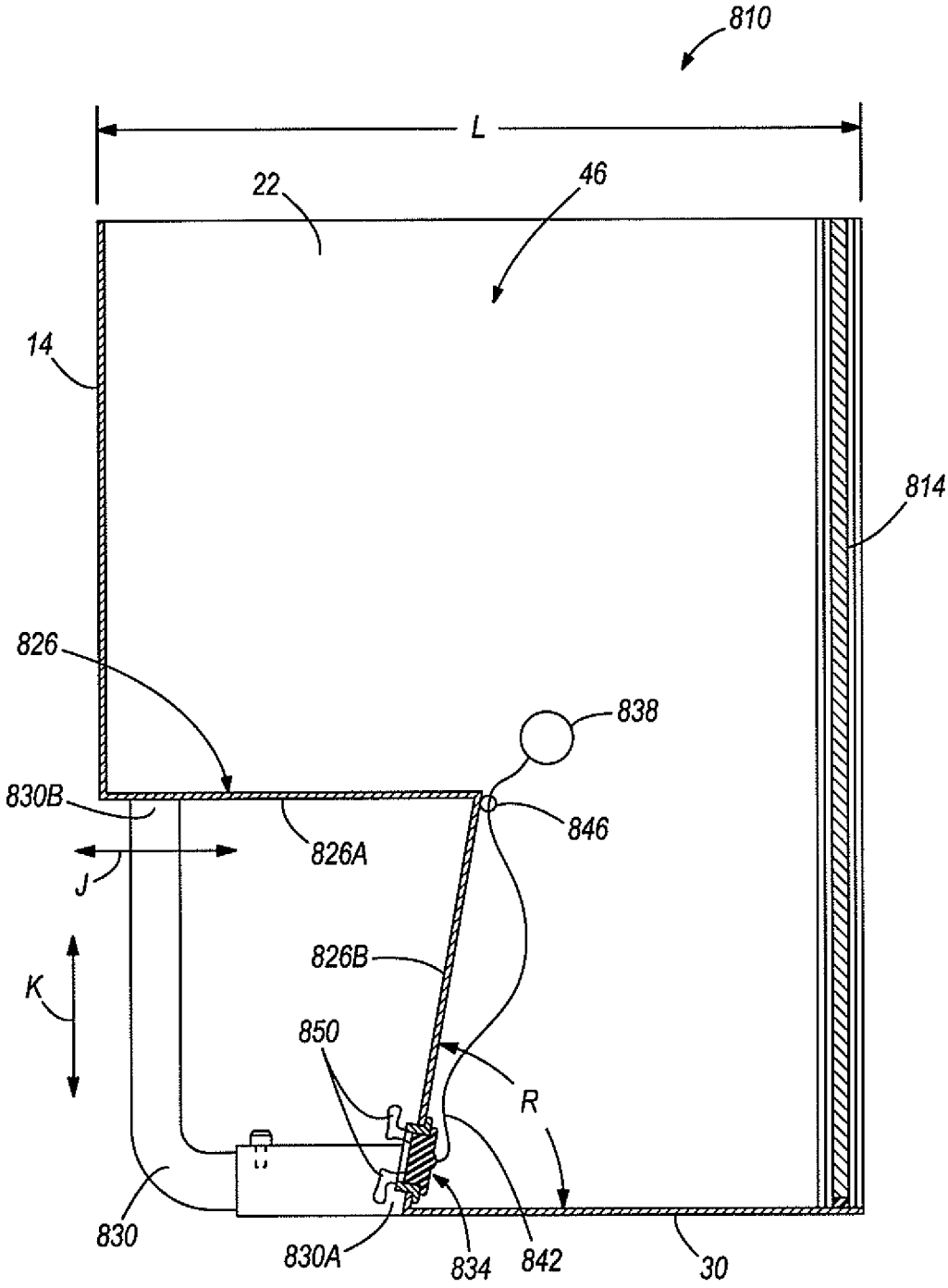
FIG. 12 is a cross section view of the bathing insert taken along line A-A of FIG. 11.

FIGS. 11 and 12 illustrate a bathtub insert 810, or bathing insert, according to another embodiment of the bathtub insert 10 shown in FIGS. 1A, 1B, 2A and 2B, whereby like structure will be identified by the same reference numerals. The insert 810 may be positioned in a bathing space (not shown), such as a conventional bathtub or shower stall, in a first orientation for use as a shower seat (not shown) and in a second orientation (FIGS. 11 and 12) for use as a deeper bathtub. The insert 810 includes a door 814 slidably received in a groove slot 818 formed in the second end wall 18 to couple the door 814 to the end wall 18. The door 814 generally extends a height of the second end wall 18. In the illustrated embodiment, the width "W" of the insert 810 is generally approximately 15 inches and the length "L" is 38 inches. In the illustrated embodiment, the door 814 is made of an acrylic material to provide a transparent door for the bather; however, in other embodiments, the door may be made of other materials such as metal, HDPE, polypropylene, LDPE, and the like.

A grommet material 822 located about the inner and outer periphery of a door opening and forms a seal between the door 814 and the groove slot 818 of the second wall 18 (FIG. 11) as well as along the upper wall 30 (FIG. 12). The grommet material 928 may be secured to the second end wall 18 and upper wall 30 by cement or other various adhesives. Types of grommet material 822 include, but are not limited to, elastomers, closed cell foam plastics, silicone, rubber, or the like. In the second orientation, the door 814 of the insert 810 is positioned proximate to the bathtub faucet.

The bathtub insert 810 includes a seat 826 having a sit portion 826A and a seatback portion 826B. The sit portion 826A extends generally inward from and substantially perpendicular to the first end wall 14 and the seatback portion 826B extends generally downward from the sit portion 826A and toward the upper wall 30. As illustrated in FIG. 12, the intersection of the upper wall 30 and seatback portion 826B forms an acute angle "R" within the bathing area 46 of the insert 810 to provide increased foot room for the user within the bathing area 46. Additional foot room allows for the bathtub insert 810 to be shorter in length and therein require less material to form the bathtub insert. In the illustrated embodiment, the foot room is increased by approximately 2-3 inches as compared to previous embodiments.

Figure 27:
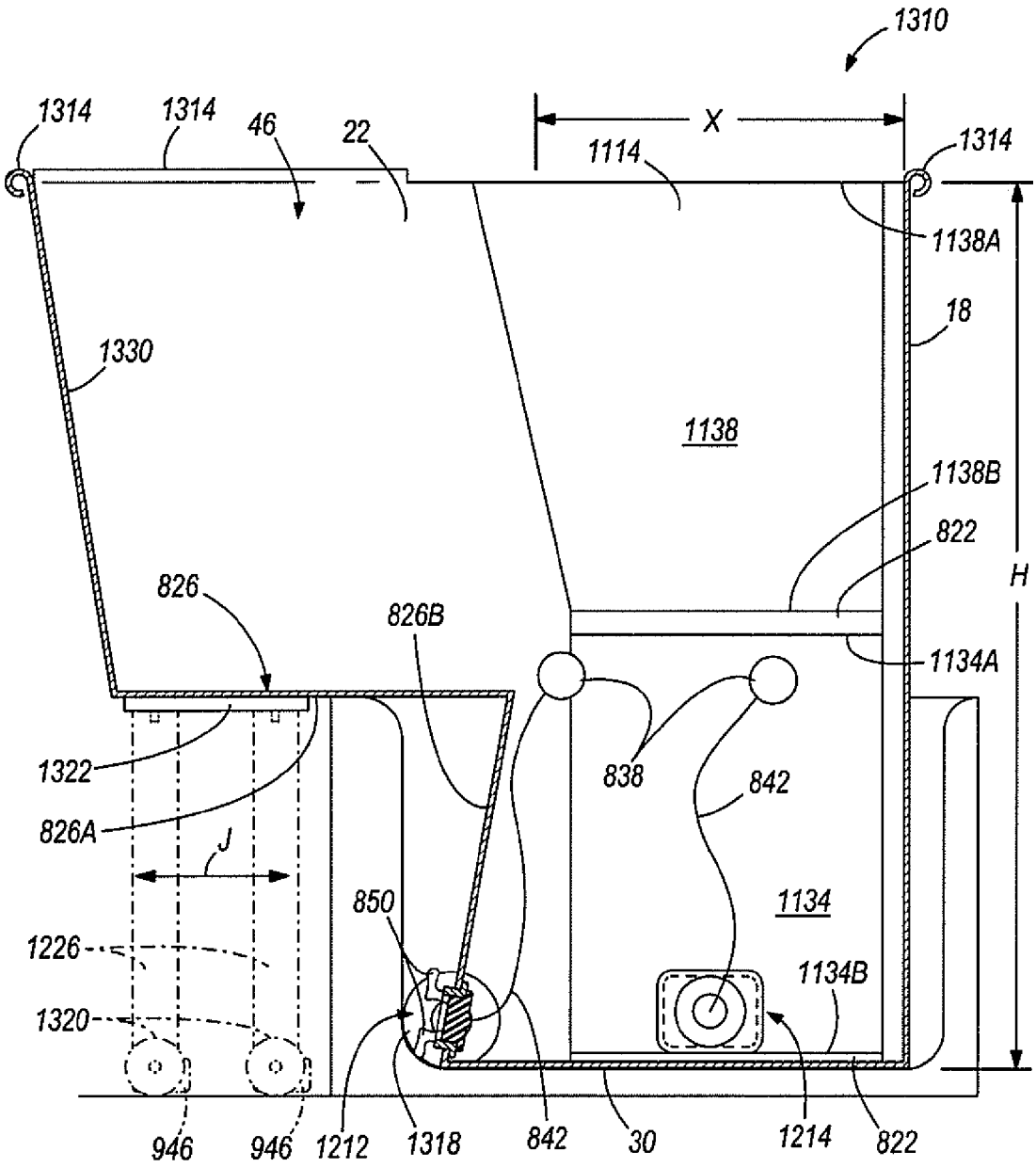
FIG. 27 is a cross section view of the bathing insert taken along line G-G of FIG. 26.

The insert 810 also includes a pair of generally L-shaped rails 830 that support the insert in the second orientation. Each of the rails 830 is adjustable and includes a first end 830A movably mounted proximate the intersection of the upper wall 30 and the respective side wall and a second end 830B movably mounted proximate the intersection of the first end wall 14 and the respective side wall. In one embodiment, a slider portion is coupled to the seatback portion 826B and the first end 830A of the rail 830 is slidably received by the slider. For example, the slider may be a metal insert roto-molded in a plastic bathtub insert 810. The second end 830B of each rail 830 is offset (about 2-3 inches in the preferred embodiment) from the first end wall 14 toward the seatback portion 826B to allow the bathtub insert 810 to reside on the support surface of the bathtub wall for increased stability of the insert 810. To create the rail 830 offset, the second end 830B of each rail 830 slides in a first direction "J" within a track (an example of a track 1322 is shown in FIG. 27) coupled to the sit portion 826A of the seat. Each rail 830 is also adjustable in a second direction "K" to adjust the length of each rail 830 and therein the standing height of the insert 810, wherein the second direction "K" is substantially perpendicular to the first direction "J". The rails 830 accommodate the insert 810 to the surfaces of conventional bathtubs and shower stalls through modifications of the rails 830 in the first and second directions. The rails may be formed from metal or plastic material.

Figure 13:
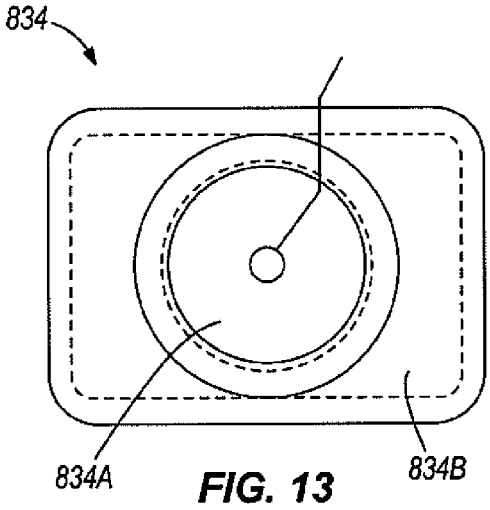
FIG. 13 illustrates a drain plug for a bathing insert.
Figure 14:
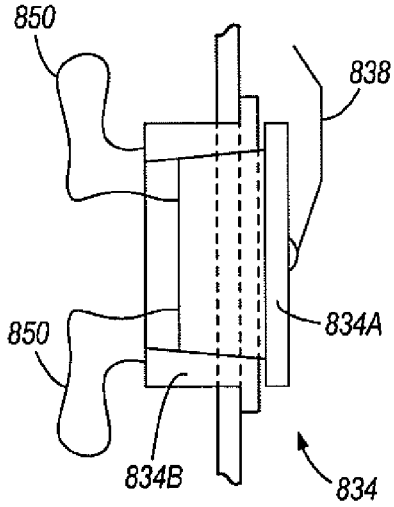
FIG. 14 is a side view of the drain plug shown in FIG. 13.

The bathtub insert 810 further includes a drain receiving a drain plug 834, a float 838, and a tether 842 connecting the drain plug 834 to the float 838. With reference to FIGS. 13 and 14, the drain plug 834 includes a first plug portion 834A and a second plug portion 834B for resisting fluid escape. The first plug portion 834A is a generally circular-shaped drain plug and the second plug portion 834B is a generally rectangular-shaped drain plug, wherein the first plug portion 834A is positioned within a periphery of the second plug portion 834B. The first and second drain portions 834A, 834B are also connected together by two tether lines 850. In the preferred embodiment illustrated, the first drain portion 834A is approximately 2 inches in diameter and the rectangular shape of the second drain portion 834B has dimensions of approximately 3 inches by approximately 4 inches. The drain plug 834 is connected to the float 838 via the tether 842. The float is composed of a material less dense than water allowing the float to either reside at the top surface of the water or be suspended within the water, restrained by the length of the tether. FIG. 12 illustrates the tether slidable within a ring or guide 846 coupled to the seatback portion 826B of the seat 826. The drain plug 834 may be formed from a variety of materials, such as plastic, rubber, elastomer, HDPE, LDPE, polypropylene, metal, etc.

A first pull on the float 838 by the user, and thereby the tether 842, dislodges the first plug portion 834A from the second plug portion 834B and the water within the bathing area 46 may escape through the second plug portion 834B. The first plug portion 834A is removed from an opening of the second plug portion 834B, but remains connected via the two tethers 850 to prevent the two portions from separating. A second pull by the user dislodges the second plug portion 834B to allow the bathing area 46 to drain water at a greater rate than that allowed by removal of the first plug portion 834A. Upon removal of both plug portions 834A, 834B, the draining time of the bathtub insert is approximately 1 minute and 30 seconds.

In other embodiments, the drain for receiving the drain plug 834 may accept a pump to therapeutically circulate water within the bathing area. Additionally, a heating unit may be installed in the seatback portion to control the water temperature within the bathing area of the insert.

To enter the bathtub insert 810, the user has to first step over the side of the bathtub or the ledge of the shower stall. Because the insert 810 is positioned within the bathtub or shower stall such that the door 814 faces the wall plumbing fixtures, the user steps between the door and the wall plumbing. The door 814 is removed from the second end wall 18 to allow the user to back into the insert 810 toward the seat 826. The door 814 is then slid into the groove slot 818 of the second end wall 18 to enclose and seal the bathing area 46 for filling. The bathing area 46 may be filled by plumbing fixtures of the bathtub or shower stall, such as a shower head or a faucet. In some cases, an apparatus, such as a hose, may be coupled to either of the shower head or the faucet to further assist in filling the bathing area. The hose may, for example, be part of common aftermarket spray handles that extend from the shower head. In each case, the user is able to access the plumbing fixtures to fill the bathing area 46 and to adjust the water to the desired temperature.

Filling the insert 810 with water increases stability of the insert and increases sealing pressure on the door 814 of the insert 810. Additional force is required to break the seal between the door 814 and second end wall 18 when water is contained within the bathing area 46 as compared to when the bathing area 46 is empty. Pulling the float 838 unplugs either the first plug portion 834A or both plug portions 834A, 834B of the drain plug 834 to allow fluid to escape from the bathing area 46. The door 814 may then be more easily removed from the second end wall 18 than when the bathing area 46 is filled with water.

Figure 15:
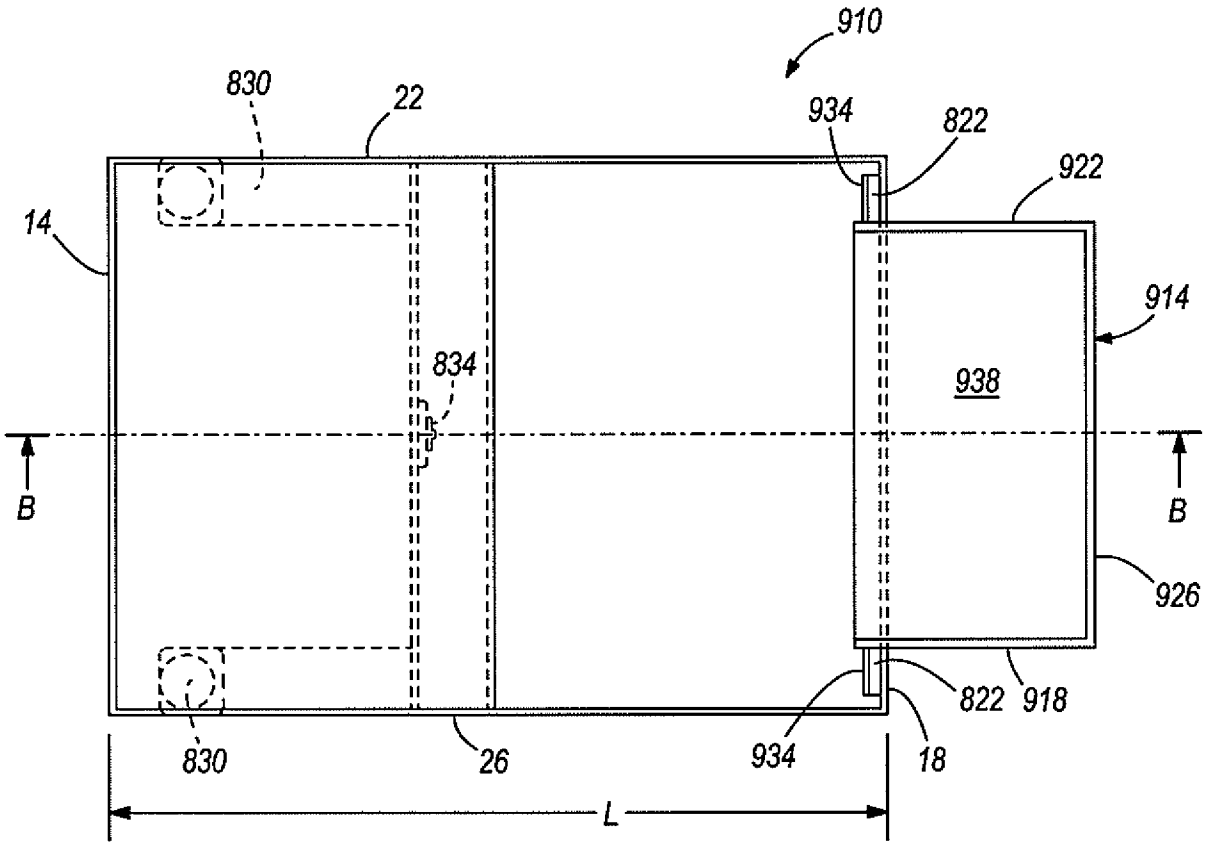
FIG. 15 is a plan view of a bathing insert according to another embodiment of the invention, the bathing insert positioned in a second orientation to provide a bathtub.
Figure 16:
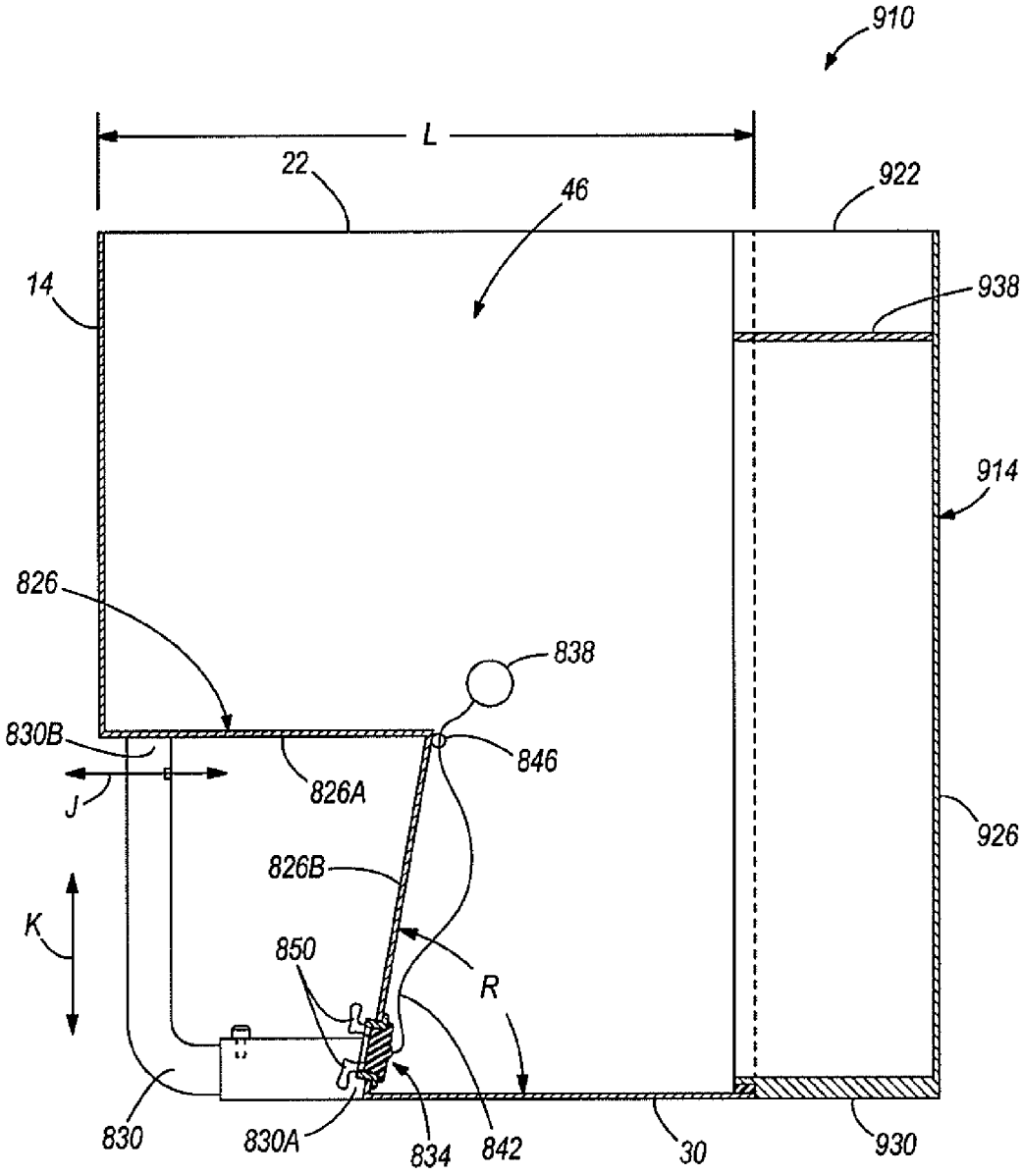
FIG. 16 is a cross section view of the bathing insert taken along line B-B of FIG. 15.

FIGS. 15 and 16 illustrate a bathtub insert 910, or bathing insert, according to another embodiment of the bathtub inserts 10, 810 shown in FIGS. 1A, 1B, 2A and 2B and FIGS. 11 and 12, respectively, whereby like structure will be identified by the same reference numerals. The insert 910 includes a door 914 shaped and configured to increase the overall bathing area 46 of the insert 910. The door 914 has a box-like configuration and includes first and second side walls 918, 922, an end wall 926 extending between the side walls 918, 922, and a base 930 connecting bottom edges of the side walls 918, 922 and the end wall 926. In the illustrated embodiment, the side walls 918, 922 of the door 914 are approximately 8 inches wide and approximately 34 inches tall. The coupling of the door 914 to the second end wall 18 increases the length of the insert 910 by approximately 7-9 inches. The side walls 918, 922, the end wall 926 and the base 930 further define the bathing area 46 of the bathtub insert 910, and the increased volume of the bathing area 46 provides more room for the user. The increased foot room and therein the increased bathing area 46 allotted by the box-like door 914 allows for the overall size of the insert 910 (excluding the door) to be generally smaller than the bathtub inserts previously discussed. For example, the insert 910 (excluding the door) has a length "L" of approximately 30 inches as compared to the insert 810 shown in FIGS. 11 and 12 having a length "L" of approximately 38 inches. In the illustrated embodiment, the door opening has a width of approximately 15 inches for allowing a user to enter the bathing area 46.

The door 914 is removably coupled to the second end wall 18 by flanges 934 that extend from the side walls 918, 922. The second end wall 18 includes gasket or grommet material 822 about an inner periphery of the door opening and additional grommet material 822 extends along the upper wall 30 proximate the second end wall 18 for sealing the door 914 to the second end wall 18 of the insert 910 at the flanges 934. As water fills the bathing area 46, the pressure exerted by the water on door 914 creates a seal between the door 914 and the second end wall 18 as the flanges 934 engage a return portion of the second end wall 18. When the door 914 is removed from the second end wall 181 the door 914 may be stored within the bathing area 46.

In the illustrated embodiment, the door 914 includes a shelf or ledge 938 (FIG. 16), extending from the end wall 926 and the side walls 918, 922. The shelf 938 provides added support and strength to the walls of the door 914 allowing the walls to be formed from a thin, light weight material, which in the illustrated embodiment is an acrylic material. The shelf 938 also provides the user with a handle to aid in insertion and removal of the door 914. In one embodiment, the shelf extends along a length of at least one of the side walls 918, 922 of the door 914.

Figure 17:
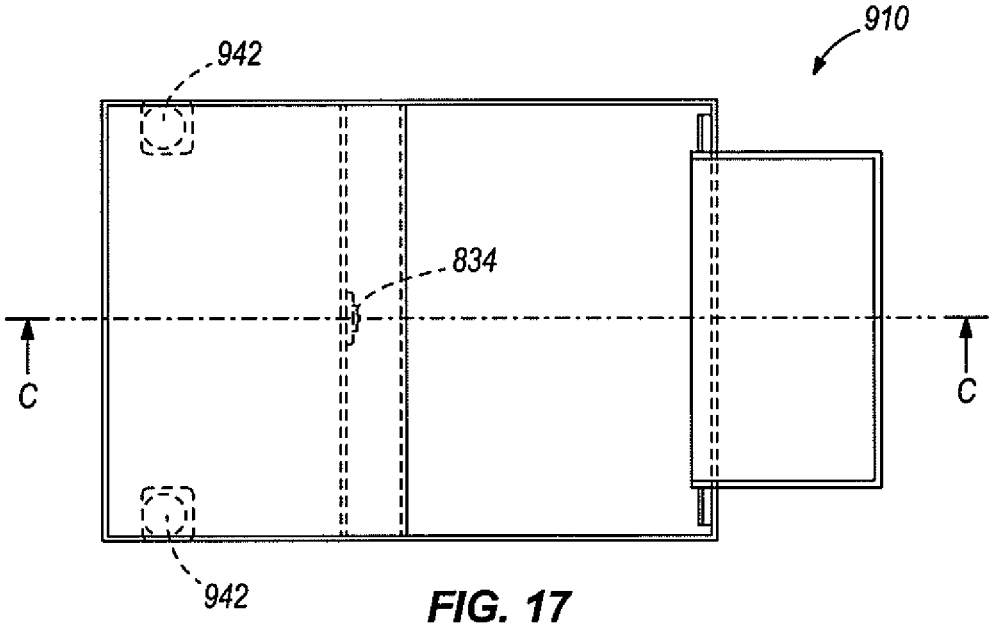
FIG. 17 is a plan view of a bathing insert according to another embodiment of the invention, the bathing insert positioned in a second orientation to provide a bathtub.
Figure 18:
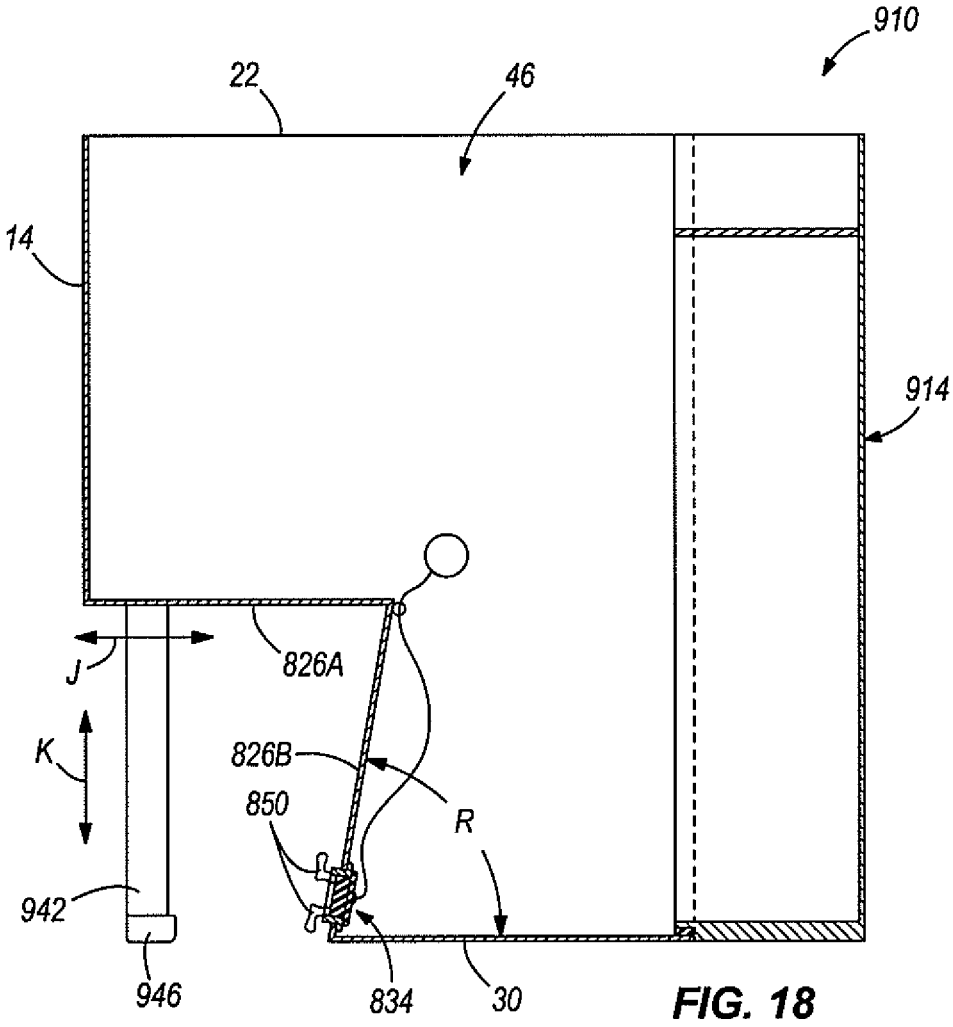
FIG. 18 is a cross section view of the bathing insert taken along line C-C of FIG. 17.

FIGS. 17 and 18 illustrate another embodiment of support legs, or rails, of the bathtub insert 910, whereby like structure will be identified by the same reference numerals. The bathtub insert 910 includes a pair of support legs or posts 942 extending outwardly (or downwardly in FIG. 18) and substantially perpendicular from the sit portion 826A for supporting the insert 910 within the bathtub or shower stall. The posts 942 are offset (about 2-3 inches in the preferred embodiment) from the first end wall 14 toward the seatback portion 826B to allow the bathtub insert 910 to reside on the support surface of the bathtub wall for increased stability of the insert 910, similar to that described for the bathtub insert shown in FIGS. 11 and 12.

The posts 942 are adjustable relative to the sit portion 826A of the seat 826, to allow the insert 910 to be placed entirely within the bathtub or shower stall. In the illustrated embodiment, the posts are movable in the first direction "J" along tracks of the sit portion 826A to offset each post 942 (approximately 2-3 inches in the preferred embodiment) from the first end wall 14 and the posts 942 have an adjustable length in the second direction "K". In one embodiment, the post 942 is slidable within a track (an example of track 1322 is shown in FIG. 27) in the first direction "J". In some embodiments, adjustments to the posts 942 in the second direction "K" may be performed with a telescoping screw and sliding members of the posts or with a sliding or telescoping sleeve (e.g., tube-in-tube). Each post 942 includes a cap 946 movably coupled to a free end of the post 942. The cap 946 adjusts to the contours of the bathtub and shower stall surface as to create a support surface for the insert 910 generally parallel to that of the bathtub or shower stall, wherein the cap 946 increases the stability of the insert 910. The cap may be formed of a metal material, such as aluminum, or plastic, and in one embodiment, may pivot about an end of the post 942. It should be readily apparent to those of skill in the art that the adjustable posts 942 may be used with any embodiment of the bathtub insert.

Figure 19:
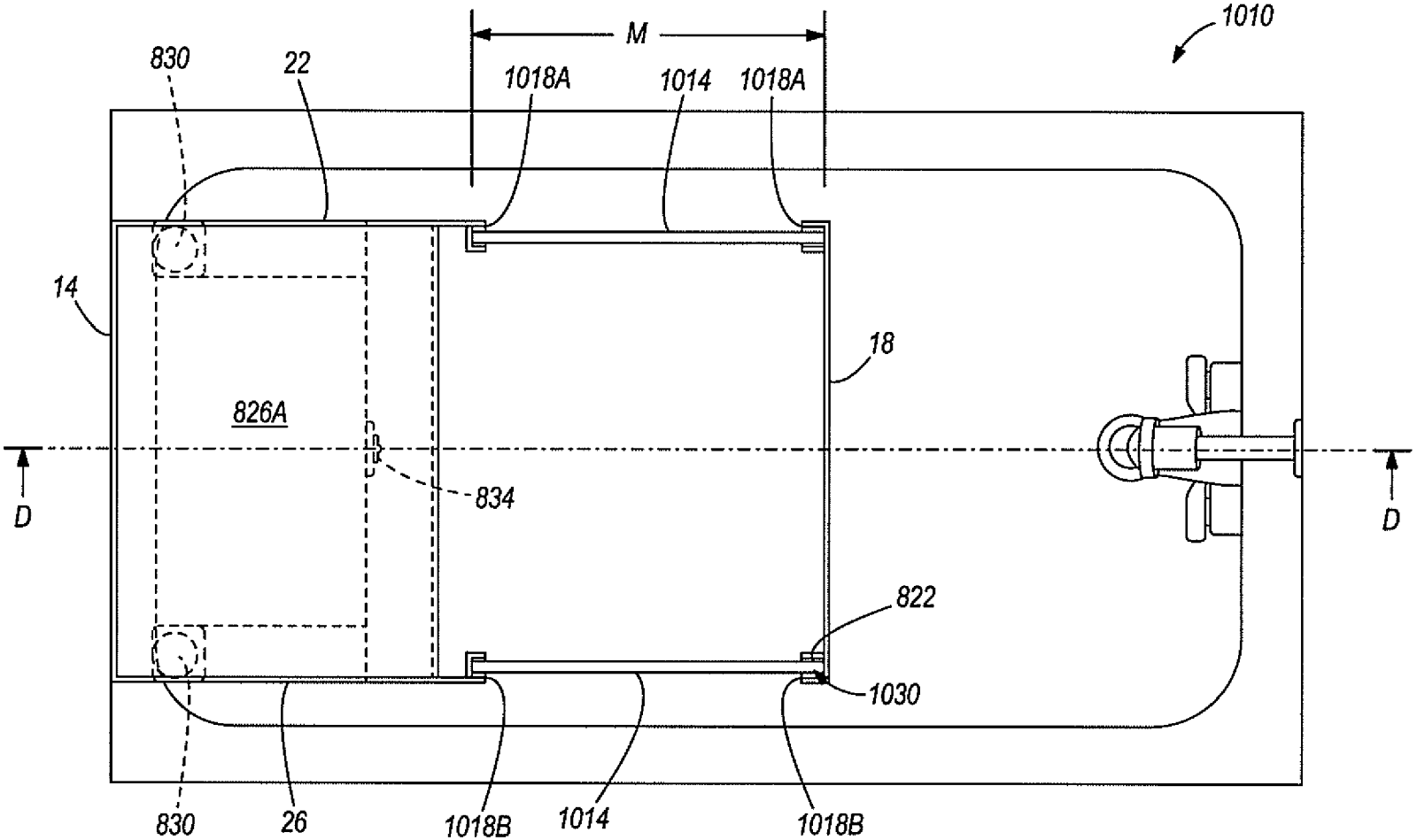
FIG. 19 is a plan view of a bathing insert according to another embodiment of the invention, the bathing insert positioned in a second orientation to provide a bathtub.
Figure 20:
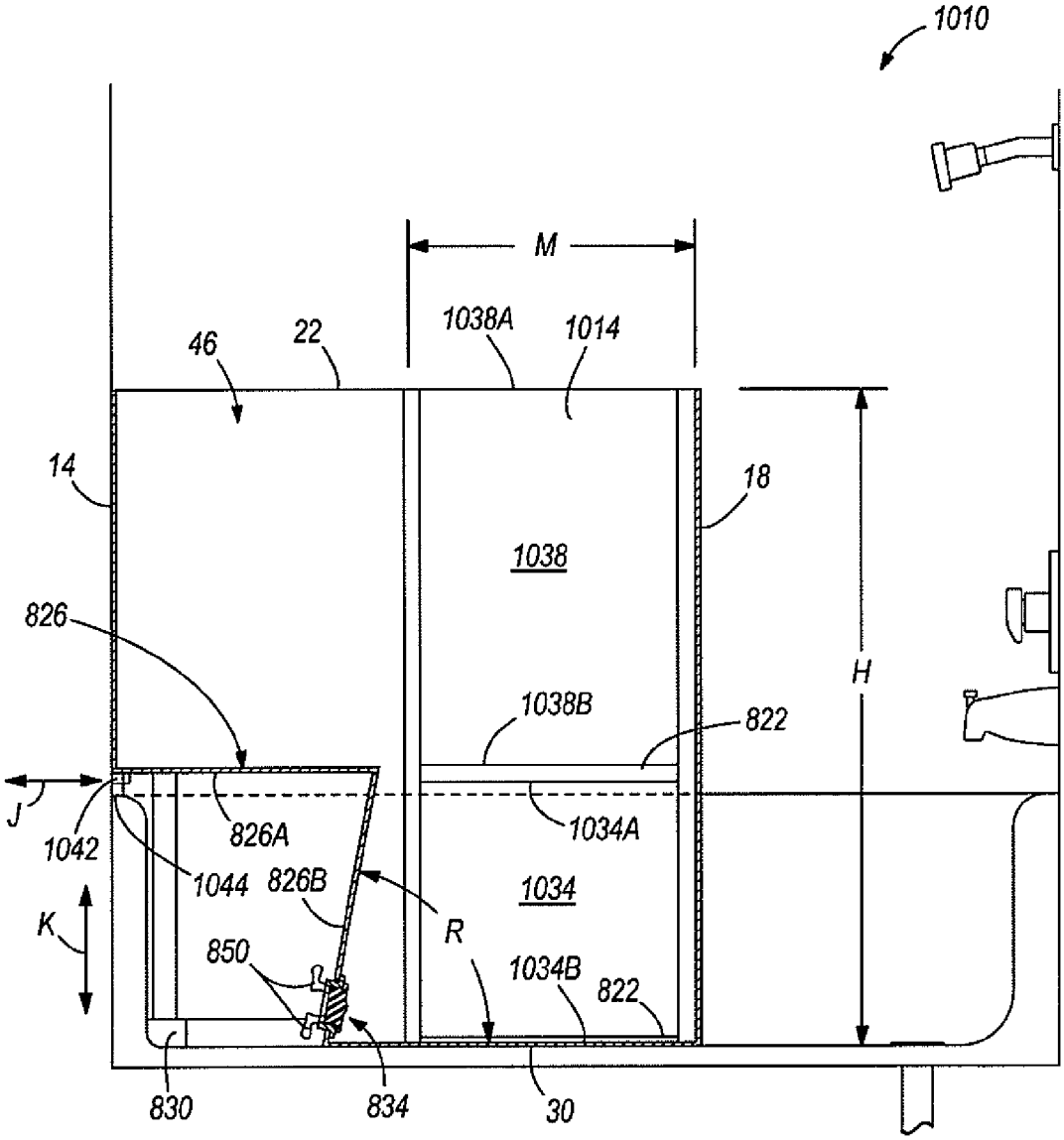
FIG. 20 is a cross section view of the bathing insert taken along line D-D of FIG. 19.

FIGS. 19 and 20 illustrate a bathtub insert 1010, or bathing insert, according to another embodiment of the bathtub inserts 10, 810 shown in FIGS. 1A, 1B, 2A and 28 and FIGS. 11 and 12, respectively, whereby like structure will be identified by the same reference numerals. As shown in FIG. 19, the insert 1010 includes a pair of doors 1014, one in each of the side walls 22, 26, for providing the user access to the bathing area 46 of the insert 1010 from a side of the bathtub. Edges 1018A, 1018B of the side walls 22, 26 define a groove slot 1030 for receiving side edges 1022A, 1022B of the respective door 1014. The tongue and groove mating along the edges of the side walls and respective doors resist a bowing effect when water pressure is exerted thereon. Each door 1014 slidably couples to the respective side wall and the grommet material 822 seals each door 1014 within the groove slots 1030 of the side wall edges 1018A, 1018B. Additionally, each door 1014 is sealed by grommet material 822 along the upper wall 30 (FIG. 20). The weight of the respective doors 1014 and the grommet material 822 seals the door 1014 to the upper wall 30. With reference to FIG. 20, each door 1014 is generally rectangular-shaped wherein a width "M" of the door 1014 between the side wall edges 1018A, 1018B is constant with respect to a height "H" of the door 1014. In the illustrated embodiment, the width "M" of each door is approximately 15 inches to approximately 16 inches.

As illustrated in FIG. 20, the insert 1010 is positioned within the bathtub such that the user faces wall plumbing fixtures when seated. A bathtub spacer 1042 supports the sit portion 826A of the seat 826 on an upper edge 1044 of the bathtub opposite of the wall plumbing fixtures. For shower stall applications, the insert 1010 may reside against the back wall. In both applications, the insert 1010 is provided with increased stability from either of the upper edge 1044 of the bathtub or the back wall of the shower stall. In one embodiment, the sit portion 826A sits directly on the upper edge 1044 of the bathtub (no spacer 1042 needed). It should be readily apparent to those of skill in the art that although the insert 1010 is illustrated with a bathtub, the insert 1010 may be used within a shower stall The pair of doors 1014 allows for use of the insert 1010 no matter what end of the bathtub includes the wall plumbing fixtures and allows the user to directly enter the insert 1010 from the exposed side of the bathtub. Generally, entrance through one of the doors 1014 is obstructed, for example, by a wall near the bathtub or a wall of the shower stall. The user is able to access the bathing area 46 of the insert 1010 through the non-obstructed door 1014 when the opposite door is obstructed. Prior to entering the bathtub insert 1010, the user typically removes the non-obstructed door 1014 of the bathtub insert 1010. If neither door is obstructed, door selection for entering the bathtub insert 1010 is at the user's discretion.

Figure 21A:
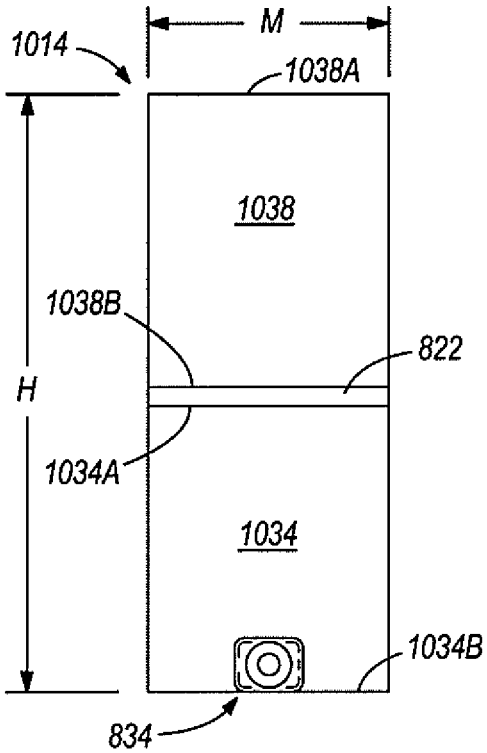
FIG. 21A illustrates a door for the bathing insert shown in FIG. 20.

As illustrated in FIGS. 20 and 21A, each door 1014 includes a first door member 1034 and a second door member 1038 removably coupled together, wherein each member 1034, 1038 is movable with respect to the side walls 22, 26 of the insert 1010 (FIG. 20). In the illustrated embodiment, upper edges 1034A, 1038A and bottom edges 1034B, 1038B of each door member 1034, 1038 incorporate the tongue and groove configuration to couple and seal the two door members 1034, 1038 together. The first and second door members 1034, 1038 may be in either of a coupled position (i.e., a first position) or a removed position (i.e., a second position). When the member 1034, 1038 is in the first position, the door member 1034, 1038 is coupled to one of the side walls 22, 26. In the second position, the door member 1034, 1038 is removed from the one side wall. With the first door member 1034 in the first position and the second door member 1038 removed from the bathtub insert 1010 (i.e., in the second position), the bathing area 46 may be partially filled with water prior to the user entering the bathing area 46. The user may choose to step over the first door member 1034 to enter the bathing area 46 prior to filling, during filling or after filling the bathing area partially. After the user has entered the bathing area 46, the second door member 1038 is placed in the first position (i.e., is coupled to the side wall) and seals with the first door member 1034 with the grommet material 822. When the second door member 1038 is sealably coupled to the first door member 1034, filling the bathing area 46 with water may continue.

Fluid exerts pressure against inner surfaces of the bathtub insert 1010 defined by the bathing area 46. The fluid pressure, as discussed above, increases the sealing pressure on each door 1014 with the side walls 22, 26. When the bathtub insert 1010 is filled with water (i.e., has fluid pressure), the second door member 1038 may be removed from the bathtub insert 1010. For example, in a scenario requiring rapid water evacuation from the bathing area 46, the second door member 1038 may be forcibly removed to partially drain the water. To remove the second door member, a force, greater than instances of no fluid pressure, is applied to the second door member 1038. The greater force on the second door member 1038 breaks the seal between the edges 1038A, 1038B of the respective door members 1034, 1038 and the seal between the second door member 1038 and respective side wall.

Figure 21B:
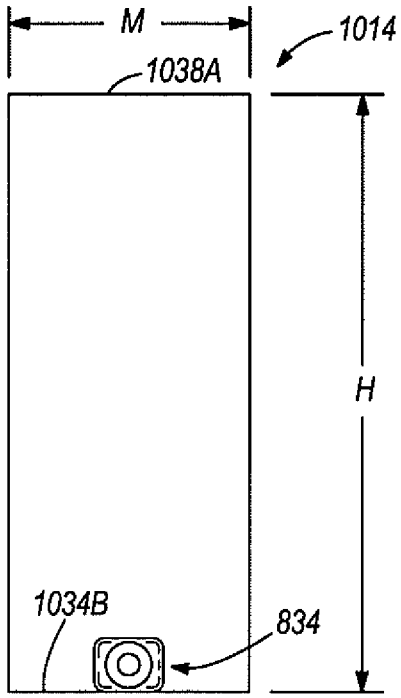
FIG. 21B-21D illustrate other embodiments of the door for the bathing insert.

In other embodiments, as shown in FIG. 21B, the door 1014 is a single member having the same overall shape as the door shown in FIG. 21A. Possible materials for the doors 1014 include metals and plastics. The manufacture of the doors 1014 and the door members 1034, 1038 may be accomplished by roto-molding or injection molding. In one embodiment, an air cavity (not shown) is formed in the door 1014 or door members 1034, 1038 during the molding to control heat loss from the water in the bathing area 46.

Figure 21C:
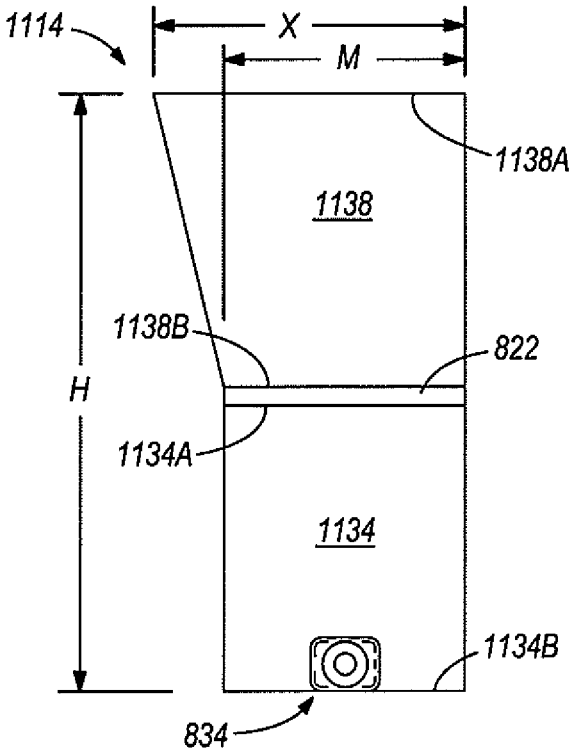
Figure 21D:
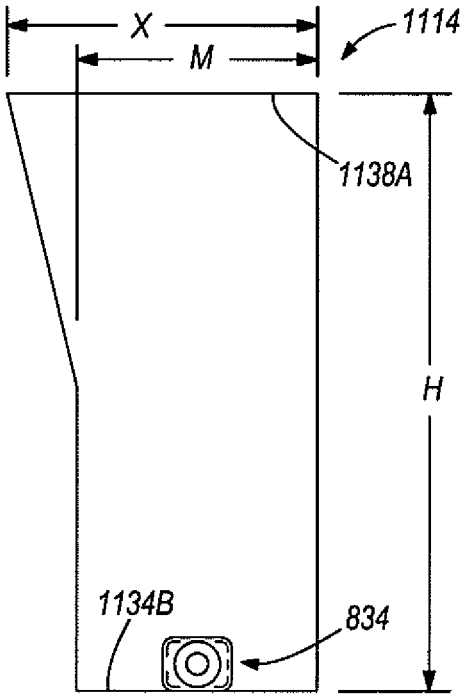
Figure 22:
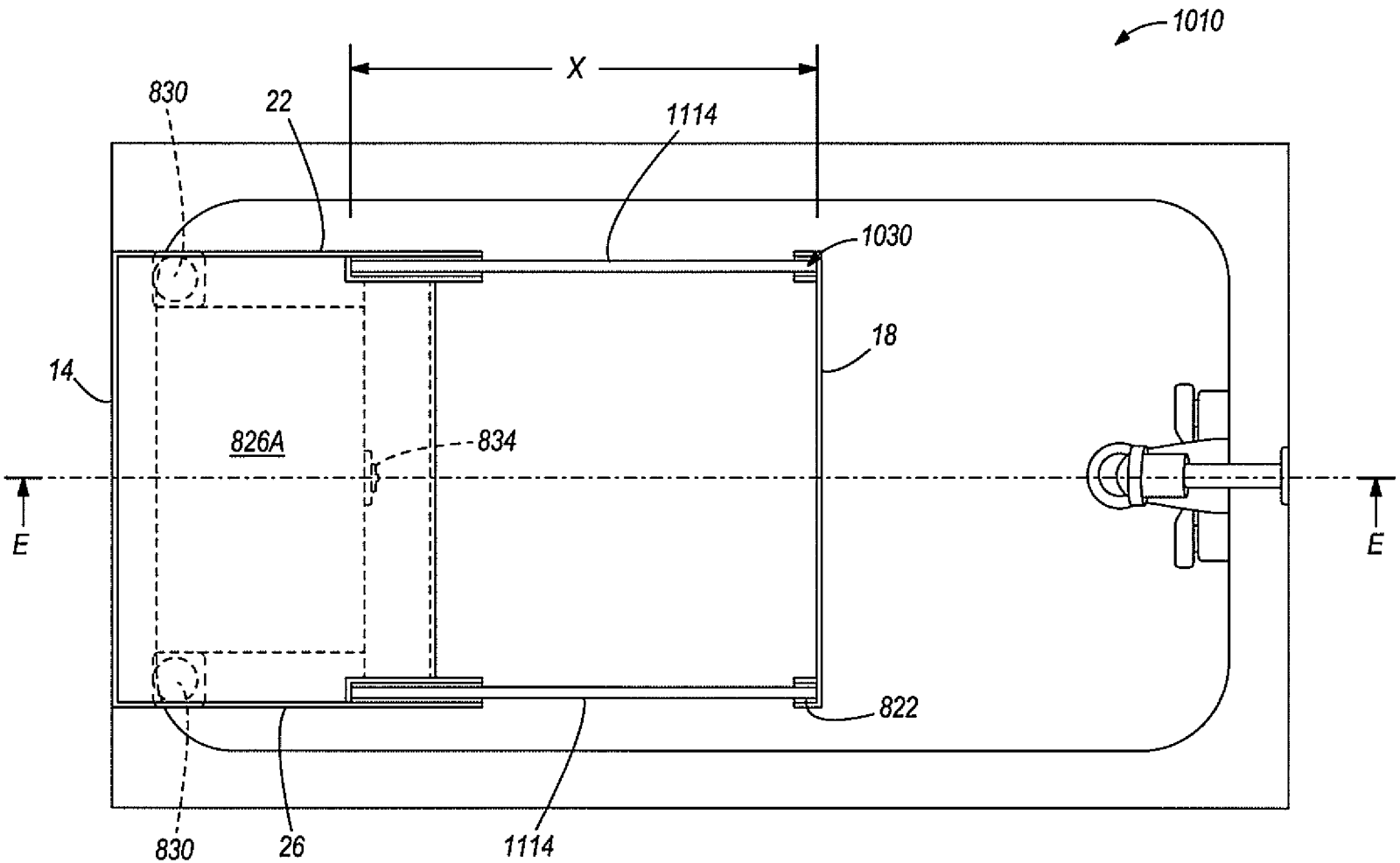
FIG. 22 is a plan view of a bathing insert according to another embodiment of the invention, the bathing insert positioned in a second orientation to provide a bathtub.
Figure 23:
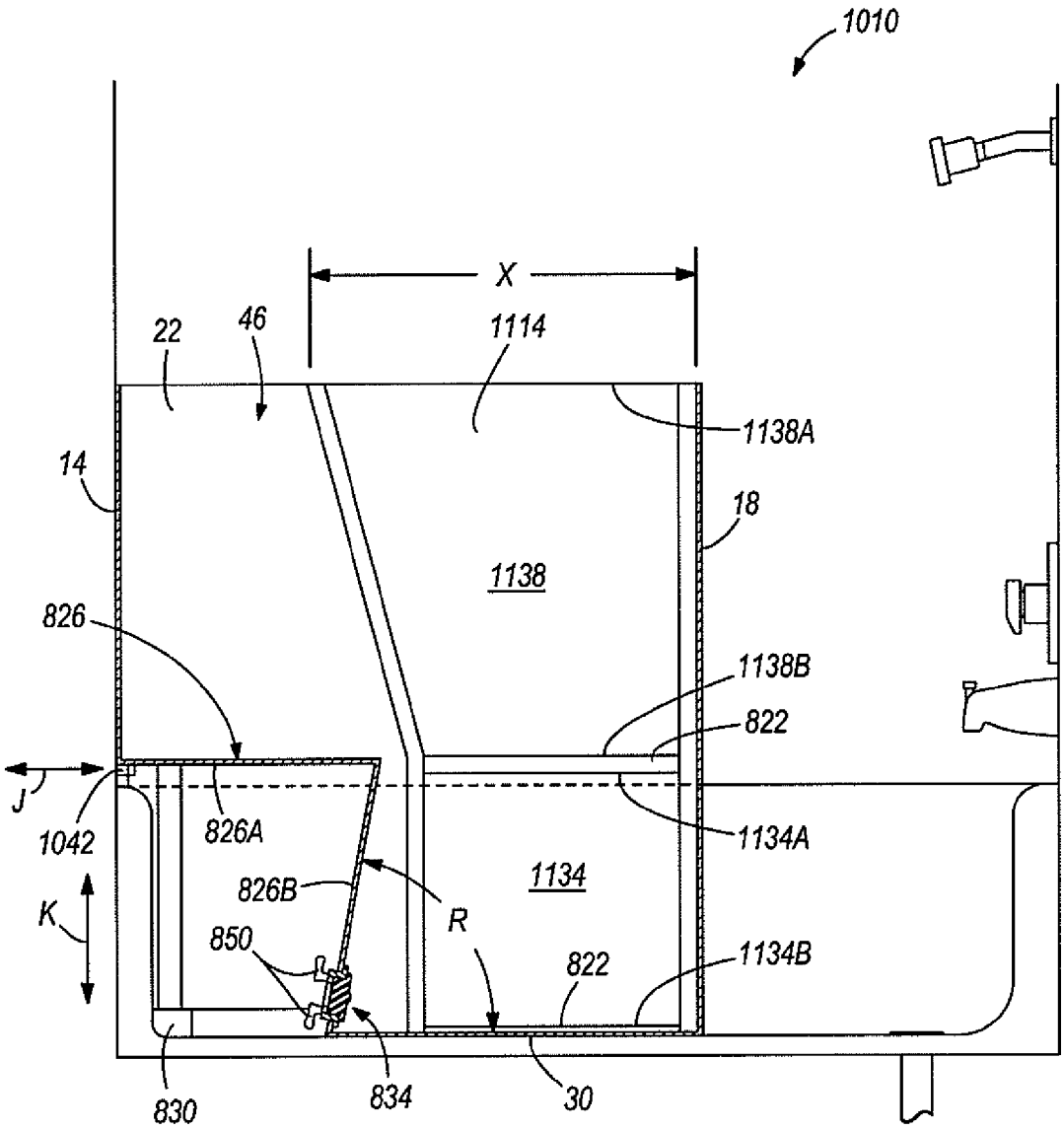
FIG. 23 is a cross section view of the bathing insert taken along line E-E of FIG. 22.

FIGS. 22 and 23 illustrate a bathtub insert 1110 according to another embodiment of the bathtub insert 1010 shown in FIGS. 19 and 20, whereby like structure will be identified by the same reference numerals. As shown in FIG. 22, the bathtub insert 1110 includes a pair of doors 1114 having a larger width "X" such that the door 1114 is a dagger-shaped door. The pair of doors 1114 include a first door member 1134 having a width "M" and edges 1134A, 1134B similar to the first door member 1034 of door 1014 shown in FIGS. 18 and 21A. The second door member 1138 has a gradually increasing width from a lower edge 1138B to an upper edge 1138A. At the lower edge 1138B, the width is approximately the same as the width "M" of the first door member 1134. The width of the second door member 1138 increases with respect to the height "H" of the door 1114 to a width "X" at the upper edge 1138B. The increased width provides a larger entrance to the bathing area 46 (e.g., for accommodating larger users). In the illustrated embodiment, the width "X" of the second door member 1138 at the upper edge 1138A is approximately 22 inches to approximately 23 inches. In other embodiments, as shown in FIG. 21D, the door 1114 is a single member having the same overall shape as the door shown in FIGS. 21C and 23.

Figure 24:
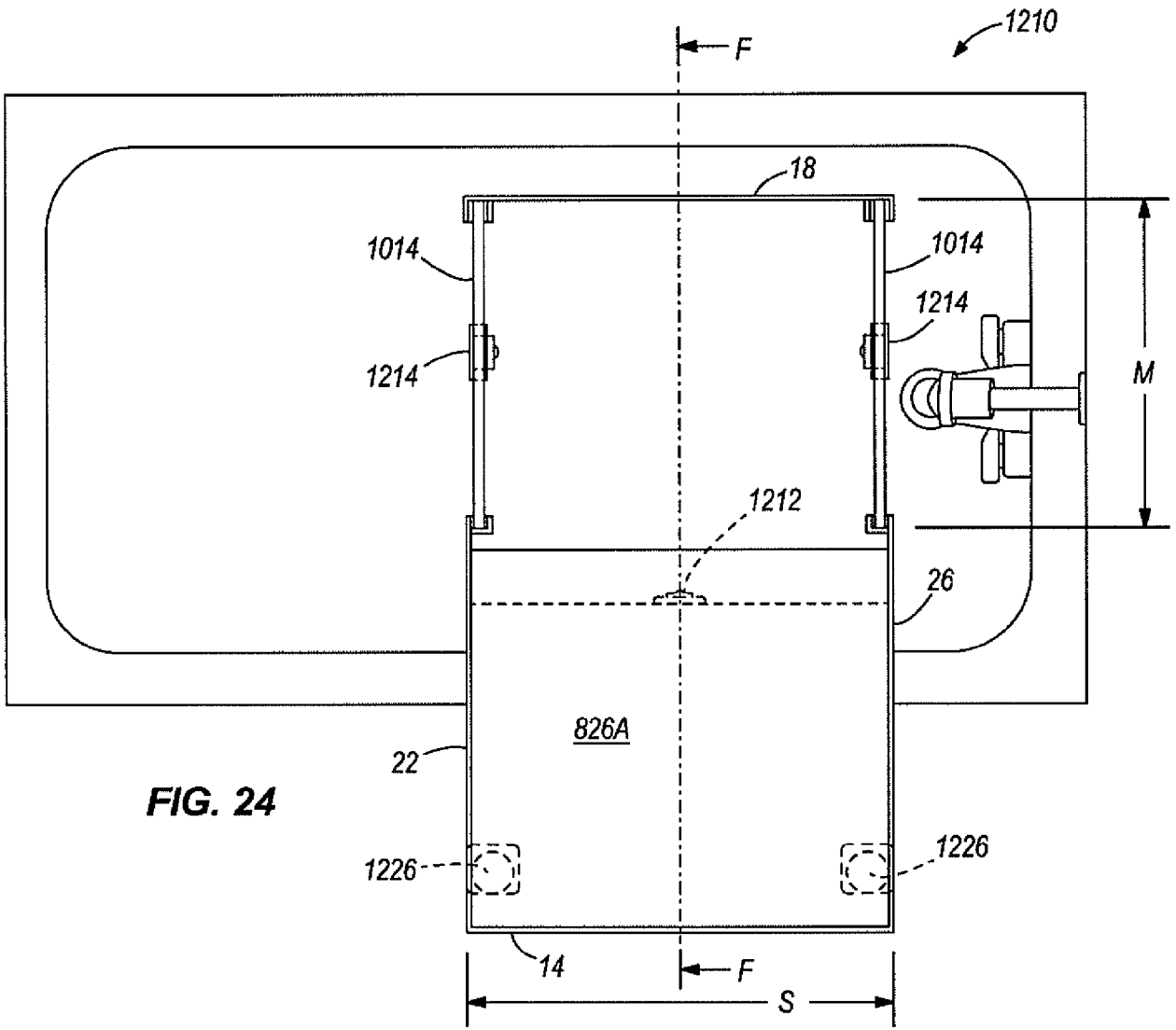
FIG. 24 is a plan view of a bathing insert according to another embodiment of the invention, the bathing insert positioned in a second orientation to provide a bathtub.
Figure 25:
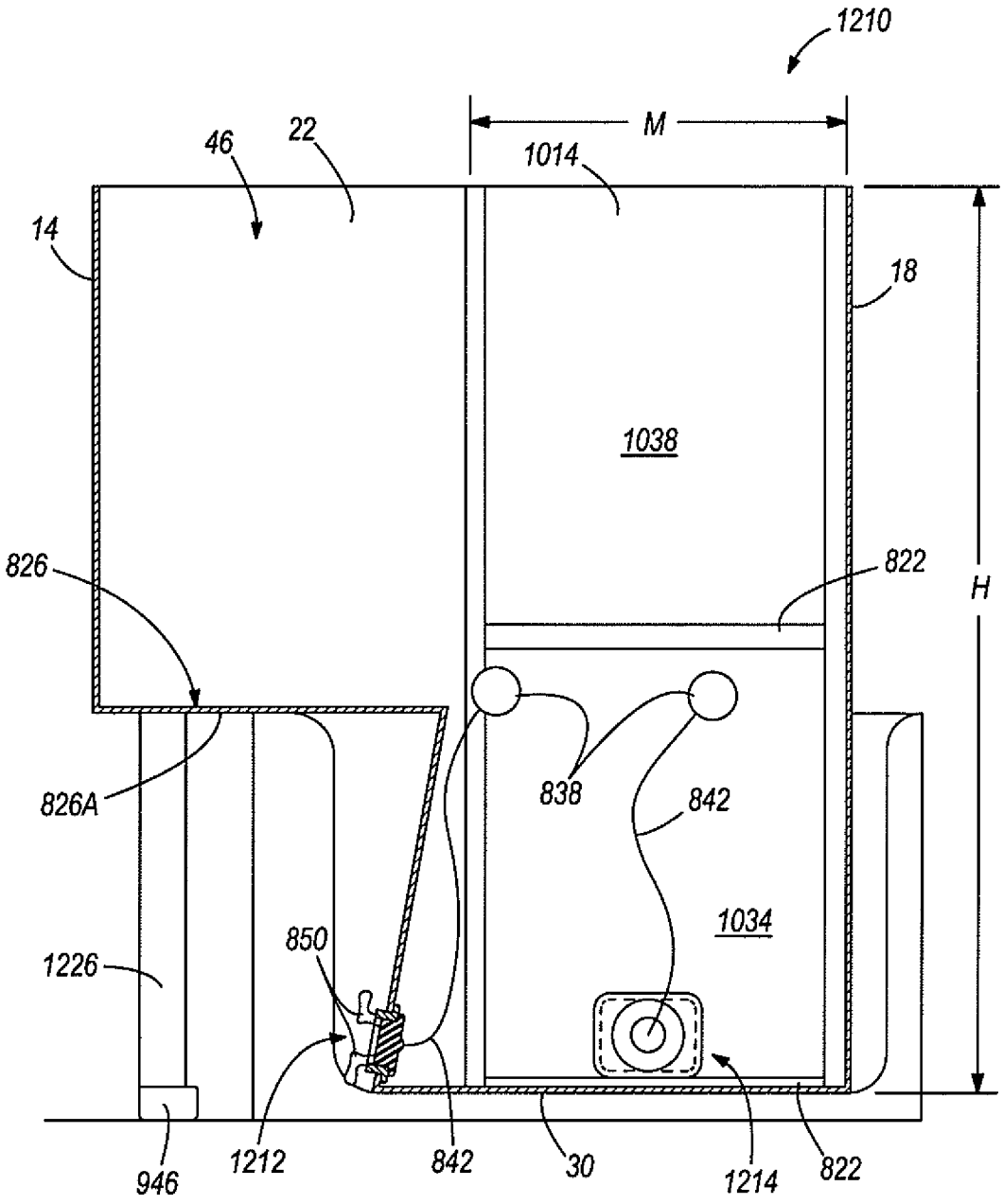
FIG. 25 is a cross section view of the bathing insert taken along line F-F of FIG. 24.

FIGS. 24 and 25 illustrate a bathtub insert 1210, or bathing insert, according to another embodiment of the bathtub insert 1010 shown in FIGS. 19 and 20, whereby like structure will be identified by the same reference numerals. As illustrated in FIG. 25, the insert 1210 is positioned in the second orientation and oriented 90° with respect to the insert 1010 shown in FIGS. 19 and 20, such that a portion of the insert 1210 is outside of the bathing space, such as a bathtub (as illustrated) or shower stall (not shown). In the illustrated embodiment, the position of the insert 1210 within the bathtub is proximate to the wall plumbing fixtures. To enter the insert 1210, the user steps over the side of the bathtub and into the bathtub. Typically, the user will enter the insert 1210 from the door 1014 opposite of the wall plumbing fixtures and keep the other door 1014 adjacent to the wall plumbing fixtures sealably coupled to the respective side wall (side wall 26 in the illustrated embodiment). Once the user is inside the bathing area 46 of the insert 1210, the user will be facing 90° away from the wall plumbing fixtures. The location of the wall plumbing fixtures does not restrict use of the bathtub insert 1210 as the user may enter through either door 1014. It should be readily apparent to those of skill in the art that in further embodiments, the insert 1210 is positioned in the second orientation and oriented less than 90° or greater than 90° with respect to the insert 1010 shown in FIGS. 19 and 20.

The insert 1210 includes two drains for emptying water from the bathing area 46, and thereby, a first drain plug 1212 and a second drain plug 1214, wherein the first and second drain plugs 1212, 1214 have respective tethers 842 and floats 838. The drain plugs 1212, 1214 have similar structure to the drain plug 834 shown in FIGS. 13 and 14. The first drain plug 1212 is positioned in the seatback portion 826B of the bathtub insert 1210, similar to that shown in FIGS. 19 and 20 and the second drain plug 1214 is positioned in the first door member 1034. The drain plugs 1212, 1214 are of similar structure to the first drain plug 834 shown in FIGS. 13 and 14. As shown in FIG. 24, both doors 1014 include the second drain plug 1214 for adapting the bathtub insert 1210 to bathtubs and shower stalls having a variety of plumbing fixture locations. In other embodiments, each door 1014 (shown as the door of FIG. 21A) may be any of the doors shown in FIGS. 21A-21D and may include the second drain plug 1214.

The orientation of the insert 1210 and the location of the second drain plug 1214 in the door 1014 allows the water to empty from the bathing area 46 in a closer vicinity to the bathing space drain as compared to the location of first drain and first drain plug 834. In addition, the second drain plug 1214 performs as a safety drain to allow for an additional draining space to evacuate water from the bathing area 46 at a greater rate than that allowed with only the first drain plug 1212. The draining time with removal both plugs 1212, 1214 is between approximately 15-30 seconds. In shower stall applications, the second drain plug 1214 is the preferred water evacuation source as the second drain plug 1214 is in closer proximity to the shower stall drain and removal of the first drain plug 834 may cause water to spill out of the shower stall. In the illustrated embodiments, sealable areas are located within the bathing space such that if leakage occurs, wall will spill out into the bathing space.

Furthermore, the insert 1210 is able to accommodate larger users by providing a greater seat width "S" and an overall width greater than the bathtub inserts discussed above. With reference to FIG. 24, the width of the seat 826 is not confined by the walls of the bathtub or shower stall and therefore the width "S" of the seat 826 may be greater than the width of the bathtub or shower stall. In the illustrated embodiment, the width "S" of the seat 826 and therein the insert 1210 is between approximately 24 inches and approximately 30 inches.

The insert 1210 also includes a pair of posts 1226, similar to those for the bathtub insert 910 shown in FIGS. 17 and 18. When the insert 1210 is placed within the bathtub or shower stall, the posts 1226 are external of the bathtub or shower stall and the upper wall 30 is within the bathtub or shower stall. In the embodiment shown in FIG. 25, the posts 1226 provide support for the insert 1210 outside of the bathtub or shower stall. The posts 1226 adjust such that the sit portion 826A of the seat 826 is either elevated above or rests against the side of the bathtub or shower stall and the upper wall 30 does not require any modifications to rest within the bathtub or shower stall. Adjustments of the post length also accommodates different surface heights between the conventional bathtub or shower stall and the floor outside of the bathtub or shower stall.

In other embodiments, the posts 1226 may be removed from the bathtub insert as a result of the existing stability from the water pressure within the bathing area and support from the side of the bathtub or shower stall.

Figure 26:
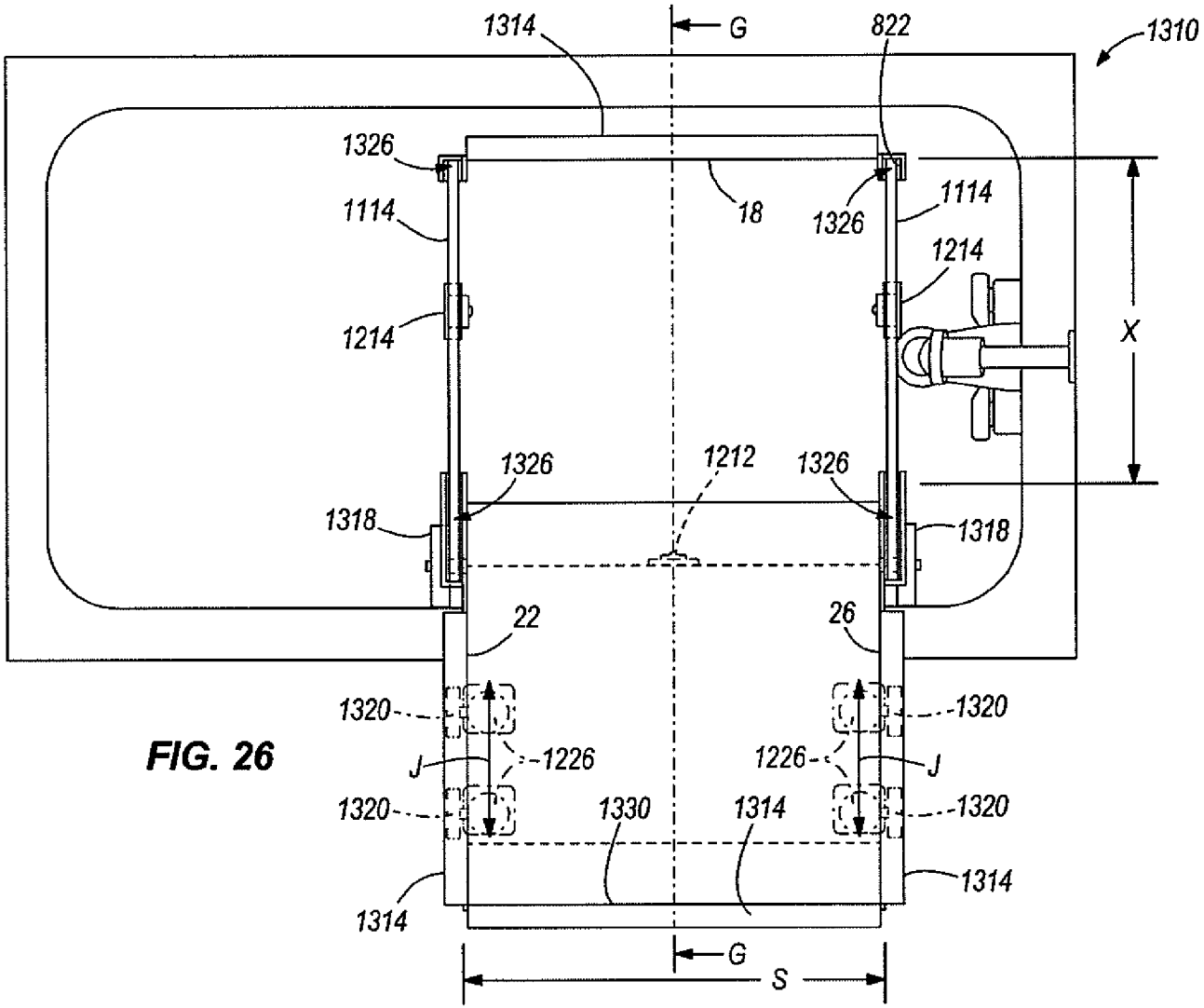
FIG. 26 is a plan view of a bathing insert according to another embodiment of the invention, the bathing insert positioned in a second orientation to provide a bathtub.

FIGS. 26 and 27 illustrate a bathtub insert 1310, or bathing insert, according to another embodiment of the bathtub insert 1210 shown in FIGS. 24 and 25, whereby like structure will be identified by the same reference numerals. The insert 1310 includes the pair of doors 1114 similar to the dagger-shaped door illustrated in FIG. 21C, handles or grips 1314, a pair of wheels 1318 coupled to the seatback portion 826B and a wheel 1320 coupled to each post 1226. The insert 1310 further includes a track 1322 for each post 1226, a groove slot 1326 for the doors 1114, and a first end wall 1330. Generally, the insert 1310 is formed of metal. It should be readily apparent to those of skill in the art that in further embodiments, the insert 1310 may be formed from various materials.

As illustrated in FIG. 26, each door 1114 includes the second drain plug 1214 positioned in the first door member 1134, similar to that shown for the insert 1210 of FIG. 25; however in other embodiments, only one door 1114 may include the second drain plug 1214. The groove slot 1326 is formed outside of the bathing area 46, as compared to the groove slot 1030 of the embodiments described above. The slot 1326 receives the door 1114 to create an impermeable seal with the grommet material 822. The groove slot 1326 is positioned outside the bathing area 46 to increase the size of the bathing area 46 and remove potential hazards, such as sharp edges created by an inner groove slot. The outer groove slot 1326, and therein the outer position of the doors 1114, increases the strength of the bathtub insert 1310.

With reference to FIGS. 26 and 27, each handle 1314 is positioned at an upper edge of the first end wall 1330, the second end wall 18, and each side wall 22, 26. Upper edges of each wall has a curved or rolled shape, which defines the respective handle 1314. Generally, the handles 1314 are formed of metal; however, in other embodiments, the handle 1314 may be formed of plastic. In addition, the handles 1314 of the first end wall 1330 and the side walls 22, 26 may be formed as a single handle. The handles 1314 provide a safety hand grip and/or a push handle for the user.

The wheels 1318 are coupled to the seatback portion 826B, adjacent opposite side walls 22, 26, to provide rolling mobility for the insert 1310. In other embodiments, the wheels 1318 are coupled to the upper wall 30. The circular shape of the wheels 1318 complement the contours of the bathtub and/or shower; therefore, easily fitting and supporting the insert 1310 within the tub. The wheels 1320 are coupled to the posts 1226 to further and/or alternatively provide rolling mobility for the insert 1310. In the illustrated embodiment, the insert 1310 includes both pairs of wheels 1318, 1320. In other embodiments, the insert 1310 may include the wheels coupled to any of the walls (e.g., the seatback portion 826B) and/or to the posts 1226.

Tracks 1322 are coupled to the sit portion 826A adjacent opposite side walls 22, 26. Each track 1322 includes a member that is able to slide in the first direction J within the track 1322. Each member includes a screw. The posts 1226 are coupled to the members via the screw and are thereby able to slide in the first direction J along the tracks 1322, as shown in FIG. 27.

The first end wall 1330 is tilted or angled with respect to the seat 826 to provide lumbar support and comfort for the user. The first end wall 1330 may be angled between approximately 96 degrees and approximately 105 degrees relative to the sit portion 826A of the seat 826.

The insert 1310 is easily movable and installable because of the wheels 1318, 1320. One method for transporting the insert 1310 requires the user to remove the posts 1226 from the tracks 1322, for example by unscrewing the posts 1226. The user then grasps at least one of the handles 1314 and tilts or pivots the insert 1310 about the pair of wheels 1318 on the seatback portion 826B. The second end wall 18 and the upper wall 30 are lifted away from the ground to cause the insert 1310 to rest directly on the pair of wheels 1318. The user applies a force on the insert 1310 (e.g., on one of the handles 1314) causing each wheel 1318 to rotate and thereby transport the insert 1310.

To install the insert 1310 in the bathtub, the user rotates the insert 1310 in a counter-clockwise direction (as shown in FIG. 27) such that the handle 1314 of the first end wall 1330 is rotated closer to the ground. The insert 1310 rotates about the pair of wheels 1318. As the insert 1310 is rotated, the second end wall 18 and the upper wall 30 are lifted away from the ground. The user places the upper wall 30 on the bathtub wall and then moves the upper wall 30, and therein the insert 1310, across the bathtub wall until the wheels 1318 engage the bathtub wall. The wheels 1318 roll along the bathtub wall and guide the insert 1310 into position within the bathtub. When the insert 1310 is positioned within the bathtub, the upper wall 30 rests on the bathtub and the wheels 1318 abut and fit against the bathtub to stabilize the insert 1310 within the bathtub. The wheels 1318 remain attached to the insert 1310 to allow the user to install and remove the insert 1310 quickly by themselves.

If the posts 1226 are removed, then the posts 1226 are reattached to the insert 1310 by screwing each post 1226 to the sliding members of the tracks 1322. The user is able to slide each post 1226 along the tracks 1322 to level, adjust and/or balance the insert 1310 within the bathtub. In other embodiments, the tracks 1322 may include a locking member, such as a pin, to engage the sliding member. The locking member may be used to resist movement of the post 1226 in the first direction J after the user has positioned the post 1226 in a desired location.

In an embodiment including the wheels 1320, another method for transporting the insert 1310 includes the posts 1226 slideably coupled to the tracks 1322. The user positions the posts 1226 relative to the seatback portion 826B to balance and support the insert 1310. The user then grasps at least one of the handles 1314 and tilts or pivots the insert 1310 about the pair of wheels 1320 on the posts 1226. The insert 1310 rests directly on the pair of wheels 1320 and the user applies a force on the insert 1310 (e.g., on one of the handles 1314) causing each wheel 1320 to rotate and thereby transport the insert 1310.

To install the insert 1310 in the bathtub when the posts 1226 are attached, the user rotates the insert 1310 in a counter-clockwise direction (as shown in FIG. 27) about the pair of wheels 1320. The user may adjust the balance point of the insert 1310 by sliding the posts 1226 in the tracks 1322 (for example, the post position closest to the seatback portion 826B in FIG. 27). As the insert 1310 is rotated, the upper wall 30 and the pair of wheels 1318 coupled to the seatback portion 826B are lifted away from the ground; although in other embodiments, the insert 1310 does not include wheels coupled to the seatback portion 826B or any of the walls. The user places the upper wall 30 on the bathtub wall and then moves the upper wall 30, and therein the insert 1310, across the bathtub wall. The insert 1310 is then lowered into the bathtub until the upper wall 30 abuts the bathtub. Similar to the method of transporting the insert 1310 with the posts 1226 removed therefrom, the user is able to slide each post 1226 along the tracks 1322 to level, adjust and/or balance the insert 1310 within the bathtub (for example, the post position furthest from the seatback portion 826B in FIG. 27).

Yet another method for transporting the insert 1310 includes the user grasping a portion of the insert 1310 (e.g., one of the handles 1314) and applying a force to insert 1310 causing each wheel 1318, 1320 to rotate and thereby roll (i.e., transport) the insert 1310 similar to how one pushes a shopping cart. To install the insert 1310, the user may remove the posts 1226 and rotate the insert 1310 about the pair of wheels 1318 coupled to the seatback portion 826B, or rotate the insert 1310 about the pair of wheels 1320, as discussed above.

In other embodiments, the insert 1310 includes two pairs of wheels positioned adjacent to corners of the upper wall 30 (e.g., coupled to the seatback portion 826B and the second end wall 18). To transport the insert 1310, the four wheels are used to roll the insert 1310 similar to how one pushes a shopping cart.

In other embodiments, the insert 1310 includes a skid material that prevents the insert 1310 from sliding within or outside of the bathtub. The skid material may be various rubber or plastic materials that are known in the art to provide traction between the upper wall 30 and an adjacent surface (e.g., the bathtub).

Figure 28:
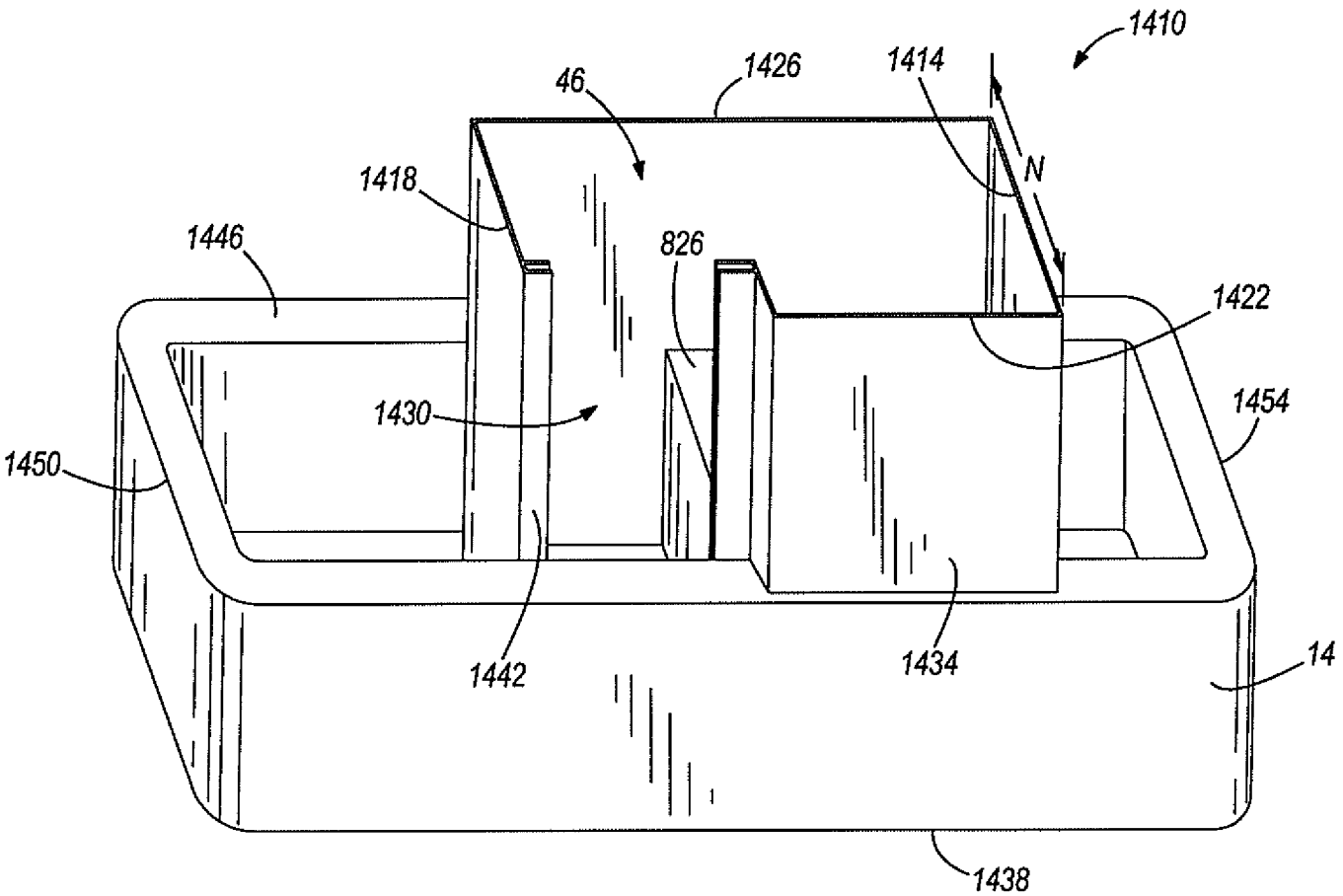
FIG. 28 is a perspective view of a bathing insert according to another embodiment of the invention, the bathing insert positioned in a second orientation to provide a bathtub.

FIG. 28 illustrates a bathtub insert 1410, or bathing insert, according to another embodiment of the bathtub insert 1010 shown in FIGS. 19 and 20, whereby like structure will be identified by the same reference numerals. The insert 1410 includes a first end wall 1414, a second end wall 1418, two side walls 1422, 1426, and a door entry 1430 in the side wall 1422. As shown in FIG. 28, the first end wall 1414 has a larger width "N" than the second end wall 1418. The larger end wall 1414 causes a first portion 1434 of the side wall 1422 to extend over a first side wall 1438 of the bathtub and create a box-like side wall structure. The box-like structure increases the width of the seat 826 to between approximately 20 inches and approximately 24 inches. In one embodiment, the box-like structure may include shelves, a gripper bar(s), a soap dish, or a return for an arm rest.

A second portion 1442 of the side wall 1422, that includes the door entry 1430 and is proximate the second end wall 1418, is flush with or adjacent to the first side wall 1438 of the bathtub. The overall length of the bathtub insert 1410 is greater (with respect to previously discussed embodiments) and therefore allows the door entry 1430 to provide the user a larger entrance to the bathing area 46 of the insert 1410 from one side of the bathtub. The door entry 1430 has an increased width (with respect to previously discussed embodiments) between approximately 17 inches to approximately 19 inches. Any of the doors shown in FIGS. 21A-21D may be used in the door entry 1430 of the bathtub insert 1410 illustrated. The user may step over the first side 1438 of the bathtub, through the door entry 1430, and into the insert 1410.

In other embodiments, the insert 1410 may be mirrored in construction such that the door entry 1430 and the first portion 1434 of the side wall 1422 are proximate a second side wall 1446 of the bathtub opposite of the first side wall 1438. Accordingly, in the mirrored construction, the seat 826 and door entry locations may be switched such that the seat 826 is proximate a first end wall 1450 of the bathtub and the door entry 1430 is proximate a second end wall 1454 of the bathtub. FIG. 28 illustrates the bathtub without plumbing fixtures; however, it should be readily apparent to those of skill in the art that plumbing fixtures may be positioned at either end of the bathtub.

In another embodiment, the doors of the bathtub inserts may have more than two door members defining each door. Although in the illustrated embodiments, the bathtub inserts are generally rectangular with squared edges, it should be readily apparent to those of skill in the art that in further embodiments the inserts may have other shapes and the corners may be rounded or bull-nosed.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A bathing insert for use with a bathing space, the bathing insert comprising:

a body including first and second end walls, first and second side walls extending between the end walls and parallel to a longitudinal axis of the body, and a support wall connecting the second end wall and the side walls, wherein the walls define an interior area of the body;

a seat including a sit portion extending generally inward from the first end wall and a seatback portion extending from the support wall to the sit portion, wherein the sit portion and seatback portion connect to define the seat, wherein the sit portion is spaced vertically from the support wall and from the open edge;

a first door in the first side wall and a second door positioned opposite from and aligned with the first door in the second side wall of the body, each of the doors positioned further from the first end wall than from the second end wall, the doors extending vertically from a top of the side walls and terminating above the support wall; and at least one vertical support extending downwardly from the sit portion, wherein when the bathing insert is positioned for use within the bathing space, the support wall of the body is positioned within the bathing space and the first end wall is external of the bathing space.

2. The bathing insert of claim 1, wherein the doors are pivotally coupled to the first and the second end wall.

3. The bathing insert of claim 1, wherein the doors are slidably coupled to the first and the second end wall.

4. The bathing insert of claim 1, wherein the doors include first and second side walls, an end wall connecting the first and second side walls, and a support wall connecting first edges of the side walls and the end wall, the walls further defining the interior area of the body.

5. The bathing insert of claim 1 wherein the doors have a generally planar structure having first and second edges that slidably couple to first and second edges of the respective side wall.

6. The bathing insert of claim 1 wherein the doors include a first door member and a second door member and each door member is separately removable from the respective side wall.

7. The bathing insert of claim 6, and further comprising a drain in the first door member.

8. The bathing insert of claim 1, and further comprising a drain in the seatback portion.

9. The bathing insert of claim 1, and further comprising a drain in the support wall of the body.

10. The bathing insert of claim 1, wherein the vertical support extends from an underside of the sit portion.

11. A bathing insert for use with a bathing space, the bathing insert comprising:

a body including first and second end walls, first and second side walls extending between the end walls, and a support wall connecting the second end wall and the side walls;

a seat including a sit portion extending generally inward from the first end wall and a seatback portion extending from the support wall to the sit portion, the sit portion spaced vertically from the support wall; and a first door in the first side wall and a second door in the second side wall of the body, each of the doors positioned further from the first end wall than from the second end wall, the doors extending vertically from a top of the side walls and terminating above the support wall; and at least one vertical support extending downwardly from the sit portion, the vertical support including a wheel to provide rolling mobility and portability for the bathing insert, wherein the support wall extends continuously between the second end wall and the seatback portion.

12. A bathing insert for use with a bathing space, the bathing insert comprising:

a body including first and second end walls, first and second side walls spaced from each other by the end walls, and a support wall connecting the second end wall and the side walls;

a seat including a sit portion extending generally inward from the first end wall and a seatback portion extending from the support wall to the sit portion, wherein the sit portion and seatback portion connect to define the seat and the sit portion is spaced vertically from the support wall;

a first door in the first side wall and a second door in the second side wall of the body, each of the doors positioned further from the first end wall than from the second end wall, the doors extending vertically from a top of the side walls and terminating above the support wall;

at least one vertical support extending downwardly from the sit portion, the vertical support including a wheel to provide rolling mobility and portability for the bathing insert;

a first drain in the seatback portion; and a second drain in the first door and a third drain in the second door.

13. A bathing insert for use with a bathing space, the bathing insert comprising:

a body including first and second end walls, first and second side walls spaced from each other by the end walls, and a support wall connecting the second end wall and the side walls;

a seat including a sit portion extending generally inward from the first end wall and a seatback portion, wherein the sit portion and seatback portion connect to define the seat and the sit portion is spaced vertically from the support wall;

at least one vertical support extending downwardly from the sit portion, the vertical support including a wheel to provide rolling mobility and portability for the bathing insert,;

a first door in the first side wall and a second door positioned in the second side wall of the body, each of the doors positioned further from the first end wall than from the second end wall, the doors extending vertically from a top of the side walls and terminating above the support wall; and at least one track to adjust the vertical support laterally beneath the sit portion of the seat.

14. A bathing system comprising:

a bathing space including at least one entry wall and two parallel supporting walls connected to the entry wall;

a bathing insert including:

a body including first and second end walls, first and second side walls extending between the end walls and parallel to a longitudinal axis of the body, and a support wall connecting the second end wall and the side walls, wherein the walls define an interior area of the body, a seat including a sit portion extending generally inward from the first end wall and a seatback portion extending from the support wall to the sit portion, wherein the sit portion and seatback portion connect to define the seat, wherein the sit portion is spaced vertically from the support wall and from the open edge, a first door in the first side wall and a second door positioned opposite from and aligned with the first door in the second side wall of the body, each of the doors positioned further from the first end wall than from the second end wall, the doors extending vertically from a top of the side walls and terminating above the support wall, and at least one vertical support extending downwardly from the sit portion at an area external of the entry wall of the bathing space, wherein when the bathing insert is positioned for use within the bathing space, the support wall of the body is positioned within the bathing space and the first end wall is external of the bathing space.

* * * * *